US005382998A

United States Patent [19]

Shida et al.

[11] Patent Number: 5,382,998

[45] Date of Patent: Jan. 17, 1995

[54] IMAGE FORMING APPARATUS OF A CLAMSHELL TYPE

[75] Inventors: Toshio Shida; Hisao Satoh; Naoko Otomo; Takeshi Sakabe; Shigeru Okazaki; Tadayoshi Ikeda; Atsushi Ogane, all of Hachioji, Japan

[73] Assignee: Konica Corporation, Tokyo, Japan

[21] Appl. No.: 40,462

[22] Filed: Apr. 1, 1993

[30] Foreign Application Priority Data

| | | | |
|---|---|---|---|
| Apr. 8, 1992 | [JP] | Japan | 4-115518 |
| Apr. 8, 1992 | [JP] | Japan | 4-115519 |
| Apr. 10, 1992 | [JP] | Japan | 4-118130 |
| Apr. 13, 1992 | [JP] | Japan | 4-119646 |

[51] Int. Cl.[6] ..... G03G 15/00

[52] U.S. Cl. ..... 355/50; 355/48; 355/200; 355/212

[58] Field of Search ..... 355/48, 50

[56] References Cited

U.S. PATENT DOCUMENTS

| | | | |
|---|---|---|---|
| 4,641,947 | 2/1987 | Ishida et al. . | |
| 4,879,580 | 11/1989 | Kaneda | 355/295 |
| 4,969,010 | 11/1990 | Tamura et al. . | |
| 5,061,961 | 10/1991 | Jacobs et al. | 355/212 |
| 5,162,846 | 11/1992 | Cahill | 355/200 |
| 5,206,681 | 4/1993 | Otomo et al. | 355/200 |

FOREIGN PATENT DOCUMENTS

| | | | |
|---|---|---|---|
| 0318969 | 6/1989 | European Pat. Off. . | |
| 0348256 | 12/1989 | European Pat. Off. . | |
| 57-078051 | 5/1982 | Japan . | |
| 59-162579 | 9/1984 | Japan . | |
| 60-008856 | 1/1985 | Japan . | |
| 60-042769 | 7/1985 | Japan . | |
| 22-25255 | 9/1990 | Japan . | |
| 40-73444 | 3/1992 | Japan . | |
| 4181953 | 6/1992 | Japan | 355/212 |

*Primary Examiner*—Michael L. Gellner
*Assistant Examiner*—Daniel P. Malley
*Attorney, Agent, or Firm*—Goodman & Woodward Frishauf, Holtz

[57] ABSTRACT

An image forming apparatus including a lower half body; an upper half body which is mounted on the lower half body and has an axis arranged in parallel to a sheet passage so that the upper half body can be pivoted around the axis; and a platen cover provided on the upper half body so as to open or close in the same direction as that of the upper half body: wherein the sum of pivot angle of the upper half body and the platen cover is smaller than 90 degrees.

16 Claims, 37 Drawing Sheets

IMAGE FORMING APPARATUS OF A CLAMSHELL TYPE

BACKGROUND OF THE INVENTION

The present invention relates to an image forming apparatus such as a copying machine of a clamshell type or a printer of a clamshell type.

Image forming apparatuses such as a copying machine and a printer both used for an office work are used extremely frequently, and they are often used by unskilled users. It is therefore desired that those image forming apparatuses are of a structure wherein users can easily cope with daily problems such as paper jamming or the like and can easily conduct simple repair, checking and cleaning for each mechanical portion.

For the purposes mentioned above, there has been proposed an image forming apparatus of a clamshell type wherein a main body of the image forming apparatus is divided into two portions, one is a lower half body in which mechanical units mainly including a sheet conveyance unit or the like are built in, and the other is an upper half body in which mechanical units mainly including an image forming process unit or the like are built in, the upper half body can be opened, when necessary, from the lower half body, and the mechanical units in both the lower and upper half bodies are within easy access and can be handled easily after a front door covering the front side of the main body is opened.

In some image forming apparatuses of a clamshell type such as those stated above, a platen cover and an automatic document feeder are provided so that they may be opened and closed in the direction which is the same as that for opening and closing of an upper half body.

However, in an image forming apparatus wherein a platen cover is provided on an upper half body, when the platen cover on the upper half body is required to be opened from the upper half body while the upper half body is held in its opened position to be away from the lower half body during the course of maintenance, for example, a document, if it is positioned in an document acceptor on the platen cover, may drop or the pages of the document may be turned, which has been a problem.

In an image forming apparatus wherein an automatic document feeder is provided on an upper half body, on the other hand, when the automatic document feeder is required to be opened from the upper half body while the upper half body is held in its opened position to be away from the lower half body during the course of maintenance, for example, there is a possibility that the apparatus inadvertently may be brought down. Granting that the apparatus is not brought down, a document positioned on the automatic document feeder may drop toward the opposite side for the opening direction of the automatic document feeder, or the pages of the document may be turned, which has been a problem.

In view of the situation mentioned above, the present invention has been achieved and its first object is to provide an image forming apparatus wherein a simple structure thereof can prevent a document from dropping, the pages of the document from being turned and the apparatus itself from being brought down.

The present invention relates to an image forming apparatus such as a copying machine or the like, and more particularly, to an image forming apparatus having therein a torque-transmission device employing gears or timing belts.

Image forming apparatuses such as a copying machine and a printer both used for an office work are used extremely frequently, and they are often used by unskilled users. It is therefore desired that those image forming apparatuses are of a structure wherein users can easily cope with daily problems such as paper jamming or the like and can easily conduct simple repair, checking and cleaning for each mechanical portion.

For the purposes mentioned above, there has been proposed an image forming apparatus of a clamshell type wherein a main body of the image forming apparatus is divided into two portions, one is a lower half body in which mechanical units mainly including a sheet conveyance unit or the like are built in, and the other is an upper half body in which mechanical units mainly including an image forming process unit or the like are built in, and the upper half body can be opened, when necessary, from the lower half body. For easier clearance of jammed transfer sheets with opened entire space over a sheet conveyance path, in particular, there is suggested an image forming apparatus of a clamshell and open-in-front type wherein the lower half body and the upper half body can be opened and closed with a supporting shaft running parallel with a sheet conveyance path as a fulcrum.

These image forming apparatuses used by general users in Japan have been required to cope with two zones differing from each other in terms of frequency (50 Hz, 60 Hz) of a power source in Japan. Accordingly, the conventional image forming apparatus has been equipped either with different motor suitable for the zone for installation of the apparatus or with a system wherein members for rotation-transmission are replaced depending on the zone for installation so that the speed of rotation may be adjusted even when the same motor is used in common.

In some image forming apparatuses of a clamshell type, a lower half body and an upper half body are equipped respectively with driving gears and driven gears to be engaged with the driving gears for the purpose of transmitting, for example, a rotary power for a photoreceptor drum provided on the upper half body from a driving motor provided on the lower half body. These gears are required to be disengaged when the upper half body is opened and to be engaged properly when the upper half body is closed.

In some conventional image forming apparatuses of the so-called sidewise-opening type, gears to be engaged with each other for torque-transmission are arranged to be capable of rotating by necessary angle freely, when they are engaged or disengaged, for smooth engagement and disengagement of the gears, as shown in, for example, Japanese Published Application No. 100459/1984. In these image forming apparatuses of the clamshell and sidewise-opening type, a side face of a gear and its moving plane are on the same plane. Therefore, there has been no fear that the side of the tip of the gear hits that of an opponent gear when the apparatus closes, and thereby a recess for interference between tips of both gears, namely a recess in the rotating direction of the gear has been enough.

In the image forming apparatus of the sidewise-opening type, however, a side face of a gear and its moving plane are not on the same plane and tips of both gears approach each other for engagement in the lateral direction when the apparatus closes. Therefore, there have been fears of occurrence of improper engagement caused by an interference between both side surfaces.

Further, it has been a cause for complicating manufacturing processes for an apparatus and also for increasing the production cost thereof that different motors are equipped in advance separately on different apparatuses to cope with two zones differing from each other in terms of power supply frequency. Even in the case of using a common motor for two zones mentioned above, it has been a complicated job for ordinary users to replace accessory members so that the apparatus may cope with each zone.

An object of the invention is to solve the aforementioned problems in an image forming apparatus, and its second object is to provide an image forming apparatus that is free, even in the case of an image forming apparatus of the open-in-front and clamshell type, from a fear of improper engagement caused by mutual interference between the sides of both gear tips.

Another object of the invention is to provide an image forming apparatus equipped with devices capable of being used in common for two different zones in terms of power supply frequency and capable of being selected easily.

However, the lower half body and the upper half body are arranged to be opened or closed with a supporting shaft cutting a sheet conveyance path at right angles as a fulcrum in the image forming apparatus mentioned above. Therefore, an entire sheet conveyance path can not be opened, and clearance of transfer sheet jamming is time-consuming, in particular. In some image forming apparatuses, therefore, the lower half body and the upper half body can be opened and closed with a supporting shaft running parallel with a sheet conveyance path as a fulcrum and a front door covering mechanical units in both the lower half body and the upper half body is provided on the side opposite to the supporting shaft for the lower half body.

Even in the case of the image forming apparatus mentioned above, the upper half body sometimes can not be opened, depending on the position of the supporting shaft for the upper half body to be opened or closed, to the extent necessary for clearing jammed sheets. Further, in some cases, when the upper half body is opened, the upper half body overhangs the lower half body and the necessary floor space of the image forming apparatus increases by the overhung length, which is a problem.

In view of the situation mentioned above, the present invention has been achieved and its third object is to provide an image forming apparatus wherein the portion above the sheet conveyance path can be opened widely and the floor space of the image forming apparatus can be secured easily.

Another transmission device for an image forming apparatus of a clamshell type includes also an example wherein each of a lower half body and an upper half body is equipped with a pulley which is a rotating object and a timing belt that is a rotation-transmitting member is spread over the pulleys.

However, the timing belt is kept being spread over the upper and lower pulleys while the upper half body is being opened. Therefore, there has been a fear that the belt suffers tension caused by the swing of the upper half body. The tension has adversely affected the timing belt and has been a cause for increasing loads of opening and closing actions.

The present invention is intended to solve the problems of an image forming apparatus mentioned and its fourth object is to provide an image forming apparatus wherein tension of a spread driving power transmitting means is lowered during opening and closing actions, resulting in a small load of opening and closing actions.

SUMMARY OF THE INVENTION

In an image forming apparatus wherein a lower half body in which a mechanical device including mainly a sheet conveyance unit or the like is built in and an upper half body in which a mechanical device including mainly an image forming process unit or the like is built in are provided, the upper half body can be opened from and closed on the lower half body, and a platen cover can be opened and closed in the direction identical to that in which the upper half body is opened and closed, the invention for achieving the first object is characterized in that the sum of an open angle of the upper half body against the lower half body and an open angle of the platen cover against the upper half body is set to be not more than 90 degrees.

In an image forming apparatus wherein a lower half body in which a mechanical device including mainly a sheet conveyance unit or the like is built in and an upper half body in which a mechanical device including mainly an image forming process unit or the like is built in are provided, the upper half body can be opened from and closed on the lower half body, and an automatic document feeder can be opened and closed in the direction identical to that in which the upper half body is opened and closed, the invention is characterized in that the sum of an open angle of the upper half body against the lower half body and an open angle of the automatic document feeder against the upper half body is set to be not more than 90 degrees.

It is further characterized that the upper half body can be opened from and closed on the lower half body with a supporting shaft running parallel with the sheet conveyance path.

In the invention, even when the platen cover is opened from the upper half body under the condition that the upper half body is opened from the lower half body in the case of maintenance service, for example, a document positioned at a document acceptor does neither fall toward the side opposite to that in which the platen cover is opened, nor the pages thereof are turned.

In the invention, even when an automatic document feeder is opened from the upper half body under the condition that the upper half body is opened from the lower half body in the case of maintenance service, for example, an apparatus is not brought down.

In the invention, an upper half body can be opened from a lower half body with a supporting shaft that is in parallel with a sheet conveyance path as a fulcrum, offering enough space above the entire surface of the sheet conveyance path for easy jam clearance.

In an image forming apparatus wherein an upper half body is supported so that it may be opened and closed while it is being rotated against a lower half body with a supporting shaft provided to be in parallel with a sheet conveyance path, and driving gears provided on the aforesaid upper half body or the lower half body are engaged with driven gears provided on the lower half body or the upper half body for transmitting driving power when the upper half body is closed in a torque-transmission mechanism, the invention for achieving the second object is characterized in that the height of engagement between the aforementioned driving gears and the driven gears is equal to that of the supporting shaft mentioned above.

In an image forming apparatus wherein an upper half body is supported so that it may be opened and closed while it is being rotated against a lower half body with a supporting shaft provided to be in parallel with a sheet conveyance path, and driving gears provided on the aforesaid upper half body or the lower half body are engaged with driven gears provided on the lower half body or the upper half body for transmitting driving power when the upper half body is closed in a torque-transmission mechanism, the invention is characterized in that aforementioned driving gears and the driven gears are bevel gears engaging with each other with their axes running parallel and the direction of an engagement plane of the gears agrees with a radius direction of a pivoting circle having its center at the supporting shaft.

In an image forming apparatus wherein an upper half body is supported so that it may be opened and closed while it is being rotated against a lower half body with a supporting shaft provided to be in parallel with a sheet conveyance path, and driving gears provided on the aforesaid upper half body or the lower half body are engaged with driven gears provided on the lower half body or the upper half body for transmitting driving power when the upper half body is closed in a torque-transmission mechanism, the invention is further characterized in that each of the aforesaid driving gears and the driven gears is equipped with a side plate that supports the rotating shaft of each gear, and the tip of each side plate forms a cam and its follower which separate vertically the tips of the driving and driven gears when the upper half body is opened and closed.

In an image forming apparatus comprising an A.C. motor which may run under two different frequencies of a power source, a driving gear affixed on a driving shaft of the A.C. motor and a driven gear that engages with the driving gear, the invention is characterized to have a shaft-sliding device wherein the aforementioned driving gear is composed of a large driving gear and a small driving gear both affixed on the same driving shaft, the aforementioned driven gear is composed of a large driven gear and a small driven gear both affixed on the same driven shaft capable of sliding in its axial direction, and the driven shaft is slid for causing the large driving gear to engage with the small driven gear to cope with one power supply frequency, and then the driven shaft is slid for causing the small driving gear to engage with the large driven gear to cope with the other power supply frequency.

In the image forming apparatus mentioned above, the invention is characterized in that the large driving gear and the small driven gear both engaging with each other and the small driving gear and the large driven gear both engaging with each other are helical gears.

In the image forming apparatus mentioned above, the aforementioned helical gears are helical gears each having a helix angle that is adjusted so that a circular pitch may be the same for the engaging helical gears.

In the invention, when an upper half body pivots to be closed around a supporting shaft as a center, a driving gear affixed on the upper half body or on the lower half body is engaged with a driven gear affixed on the lower half body or on the upper half body at the height of the supporting shaft. Namely, a pivoting locus of engaging portions of a gear affixed on the upper half body starts from the point that is on the same level as the supporting shaft which is a center of pivoting of the upper half body. Therefore, gears on the upper half body approach or leave those on the lower half body mostly vertically, resulting in elimination of improper engagement caused by mutual interference of sides of gear tips.

In the invention, when an upper half body pivots to be closed around a supporting shaft as a center, a bevel gear affixed on the upper half body engages with a bevel gear affixed on the lower half body with their axes running parallel. In this case, the direction of an engagement plane of the gears agrees with a radius direction of a pivoting circle having its center at the supporting shaft. Therefore, bevel gears on the upper half approach and engage with those on the lower half body in the tangential direction of the pivoting circle, namely, vertically to the direction of the engagement plane. Accordingly, bevel gears on the upper half body approach or leave those on the lower half body mostly vertically to the engagement plane of the gears, resulting in elimination of improper engagement caused by mutual interference of sides of gear tips.

Furthermore, when an upper half body pivots to be closed around a supporting shaft as a center, the tip of the side plate supporting a rotating shaft of the driving gear or the driven gear provided on the half body rotates while it keeps touching the tip of a side plate supporting a rotating shaft of the driven gear or the driven gear provided on the lower half body. These tips form a cam and a follower both of which separate gear tips vertically. Therefore, gears on the upper half body approach or leave those on the lower half body mostly vertically, resulting in elimination of improper engagement caused by mutual interference of sides of gear tips.

To cope with the power supply frequency to be used, a driven shaft is slid so that a large driving gear may be engaged with a small driven, or a small driving gear may be engaged with a large driven gear.

By employing helical gears in the image forming apparatus mentioned above, it is possible to increase the number of teeth in mesh to obtain → smooth engagement of gears which may withstand high speed rotation.

With regard to two different combinations of a pair of helical gears in mesh, each pair being apart by the same distance between two shafts, the number of teeth and a helical angle are adjusted based on the revolution per minute of the driving shaft caused by each power supply frequency so that circular pitches of helical gears in mesh may be the same.

In an image forming apparatus wherein a lower half body in which a mechanical device including mainly a sheet conveyance unit or the like is built in and an upper half body in which a mechanical device including mainly an image forming process unit or the like is built in are provided, both the mechanical device in the lower half body and the mechanical device in the upper half body being linked through a power linkage unit, and the upper half body can be opened from and closed on the lower half body with a supporting shaft running parallel with the sheet conveyance path as a fulcrum, and further a front door covering the mechanical devices in the lower half body and the upper half body mentioned above is provided on the side opposite to the aforementioned supporting shaft on the lower half body, the invention for achieving the third object is characterized in that the aforesaid front door is provided on one side and the aforesaid supporting shaft is provided on the other side both of the aforesaid sheet conveyance path, and the supporting shaft is positioned to be out of the width of the aforesaid sheet conveyance path.

In the image forming apparatus mentioned above, it is characterized that the width of the sheet conveyance path is equal to or more than the width of the maximum transfer sheet.

In the image forming apparatus mentioned above, it is characterized that the aforesaid front door is provided on one side of the sheet conveyance path mentioned above and the supporting shaft is provided on the other side thereof, and the supporting shaft is located above the sheet conveyance path.

In the image forming apparatus mentioned above, it is characterized that the aforesaid front door is provided on one side of the sheet conveyance path mentioned above and the supporting shaft is provided on the other side thereof, and the supporting shaft is located above the power linkage unit.

In the invention, the upper half body is opened and closed with a supporting shaft as a fulcrum, and the supporting shaft is positioned to be out of the width of the sheet conveyance path. Therefore, the upper half body can be opened to make enough space over the sheet conveyance path.

The width of the sheet conveyance path which is equal to or greater than the width of the maximum transfer sheet makes it possible to convey a transfer sheet smoothly.

In the invention, the upper half body is opened and closed with a supporting shaft as a fulcrum, and the supporting shaft is located above the sheet conveyance path. Therefore, it is possible to limit the amount overhanging the lower half body caused by the opening of the upper half body.

In the invention, the upper half body is opened and closed with a supporting shaft as a fulcrum, and the supporting shaft is located above the power linkage unit. Therefore, it is possible to limit the amount overhanging the lower half body caused by the opening of the upper half body.

In an image forming apparatus comprising a lower half body provided mainly with a device such as a sheet conveyance unit or the like built therein, an upper half body provided mainly with a device such as an image forming process unit or the like built therein, a supporting shaft running parallel with a sheet conveyance path for supporting the upper half body so that it may rotate to be opened away from or closed toward the lower half body, a lower rotating object to be provided on the lower half body, an upper rotating object to be provided on the upper half body, and a spread power-transmitting means for linking the upper rotating object with the lower rotating object, the invention for achieving the fourth object mentioned above is characterized in that the upper rotating object is positioned behind the supporting shaft.

In the image forming apparatus mentioned above, it is characterized that the upper surface of the upper rotating body contacting the spread power-transmitting means is positioned either on the same level as the supporting shaft or under the supporting shaft.

Furthermore, in an image forming apparatus comprising an AC motor that may run under either one of two different power supply frequencies, a driving pulley affixed on a driving shaft of the AC motor and a driven pulley that is driven by the driving pulley through the spread power-transmitting means to receive the necessary rotation, the invention is characterized in that the driving pulley is a 2-step pulley having different diameters capable of being selected for the speed of rotation based on the power supply frequency and the spread power-transmitting means is provided with a tension roller that gives tension to the spread power-transmitting means corresponding to the selected diameter of the 2-step pulley.

It is characterized in the invention that the shaft of the driven pulley mentioned above has a width equal to or greater than the width equivalent to two steps of the driving pulley.

It is characterized in the invention that the width of the tension roller mentioned above is equal to or greater than the width equivalent to two steps of the driving pulley.

When the upper half body is pivoted to be opened with the supporting axis as a fulcrum, an upper rotating object provided at the rear side of the supporting axis rotates downward. Therefore, the tension applied on a spread power-transmitting means that is stretched over the upper rotating object is lowered.

Since the upper surface of the upper rotating object contacting the spread power-transmitting means is positioned under the supporting axis, a locus for the movement of the upper rotating object in the course of its opening is positioned inside that of closing, namely, the locus is positioned at the side of the supporting axis. Therefore, the space behind the upper rotating object is broadened.

After selecting the diameter on a driving pulley corresponding to the power supply frequency available in the zone where the apparatus is used, the spread power transmitting means is stretched thereon. In this case, a tension roller is adjusted so that the spread power-transmitting means may be stretched properly without having any slack.

The width of a driven pulley is equal to or greater than the length equivalent to two steps of the driving pulley so that the spread power-transmitting means may be spread over the selected diameter smoothly.

The width of a tension roller is equal to or greater than the length equivalent to two steps of the driving pulley so that the spread power-transmitting means may be spread over the selected diameter smoothly.

DETAILED DESCRIPTION OF THE INVENTION

Figure 1:
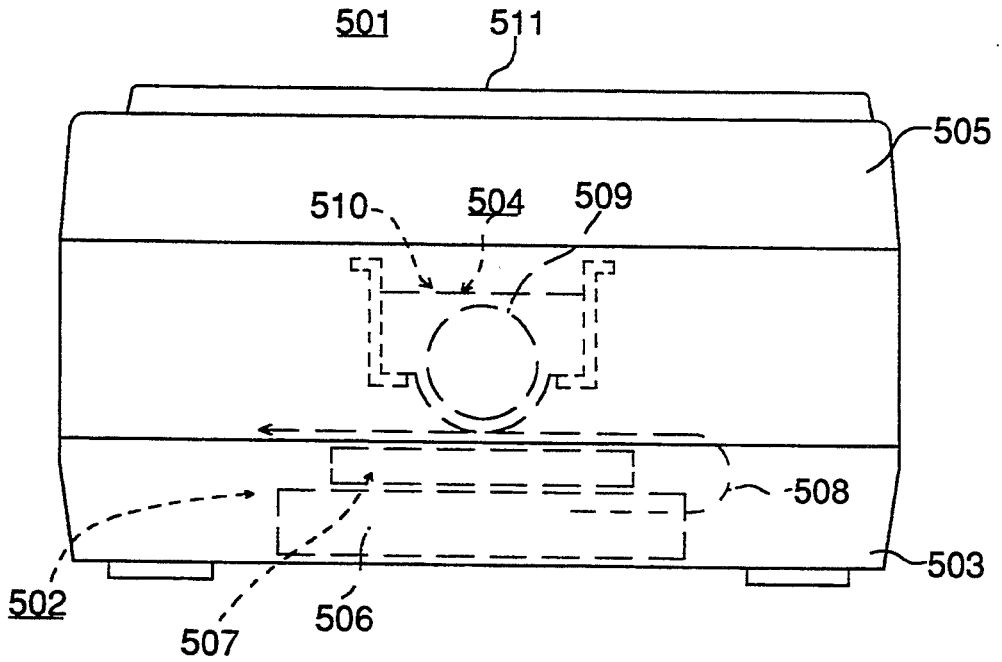
FIG. 1 (*a*) is a front view of an image forming apparatus achieving the third object of the invention, FIG. 1(*b*) is a side view of the right side of the image forming apparatus in FIG. 1(*a*), and FIG. 1(*c*) is a right-hand side view showing the opened state of the image forming apparatus in FIG. 1.
Figure 1:
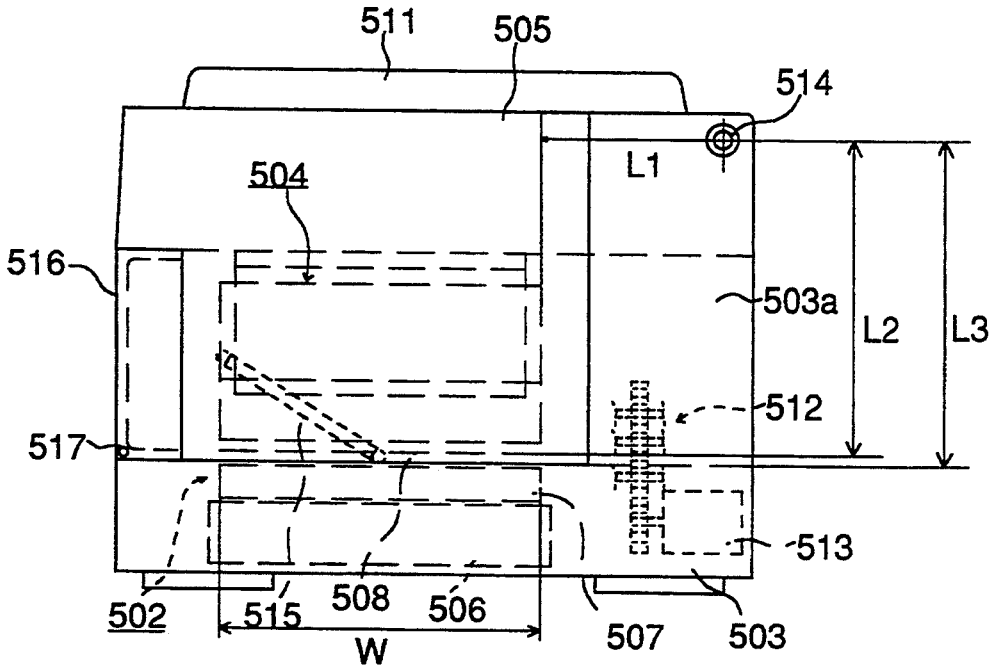
Figure 1:
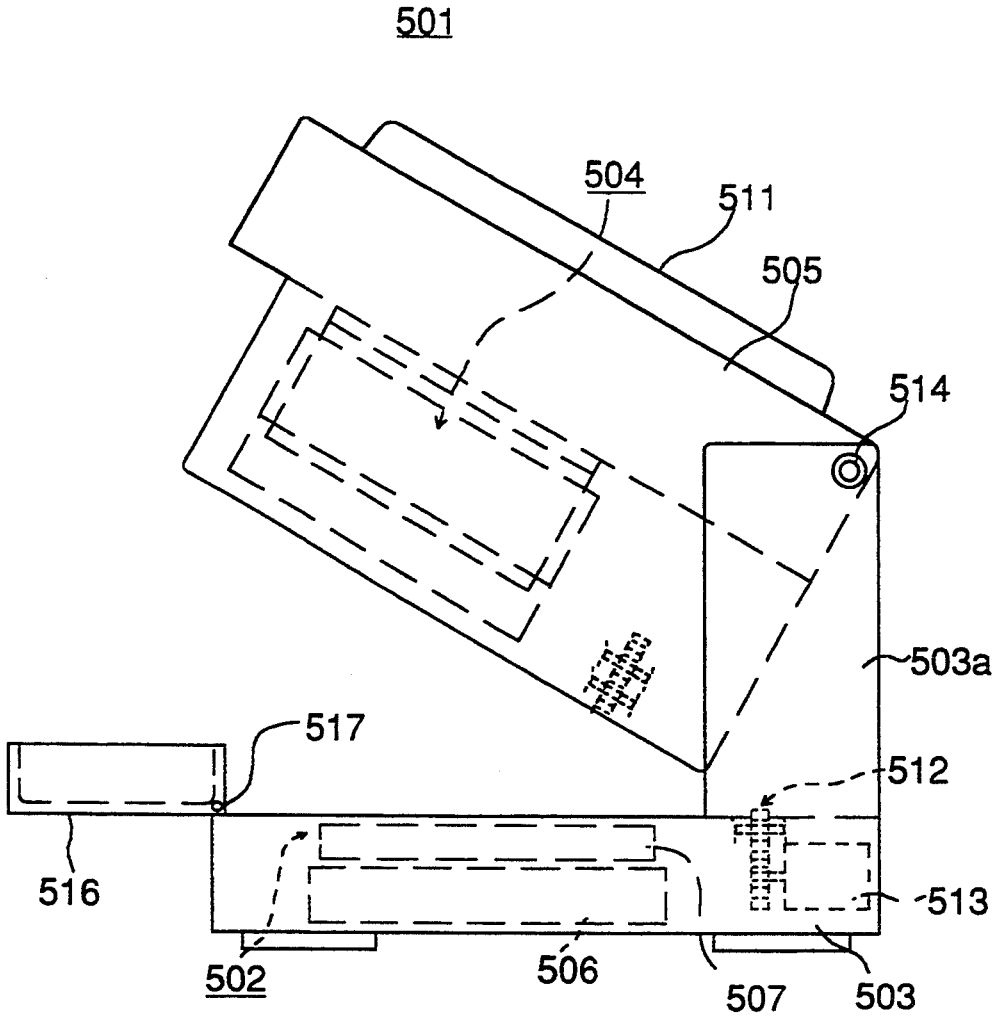
Figure 2:
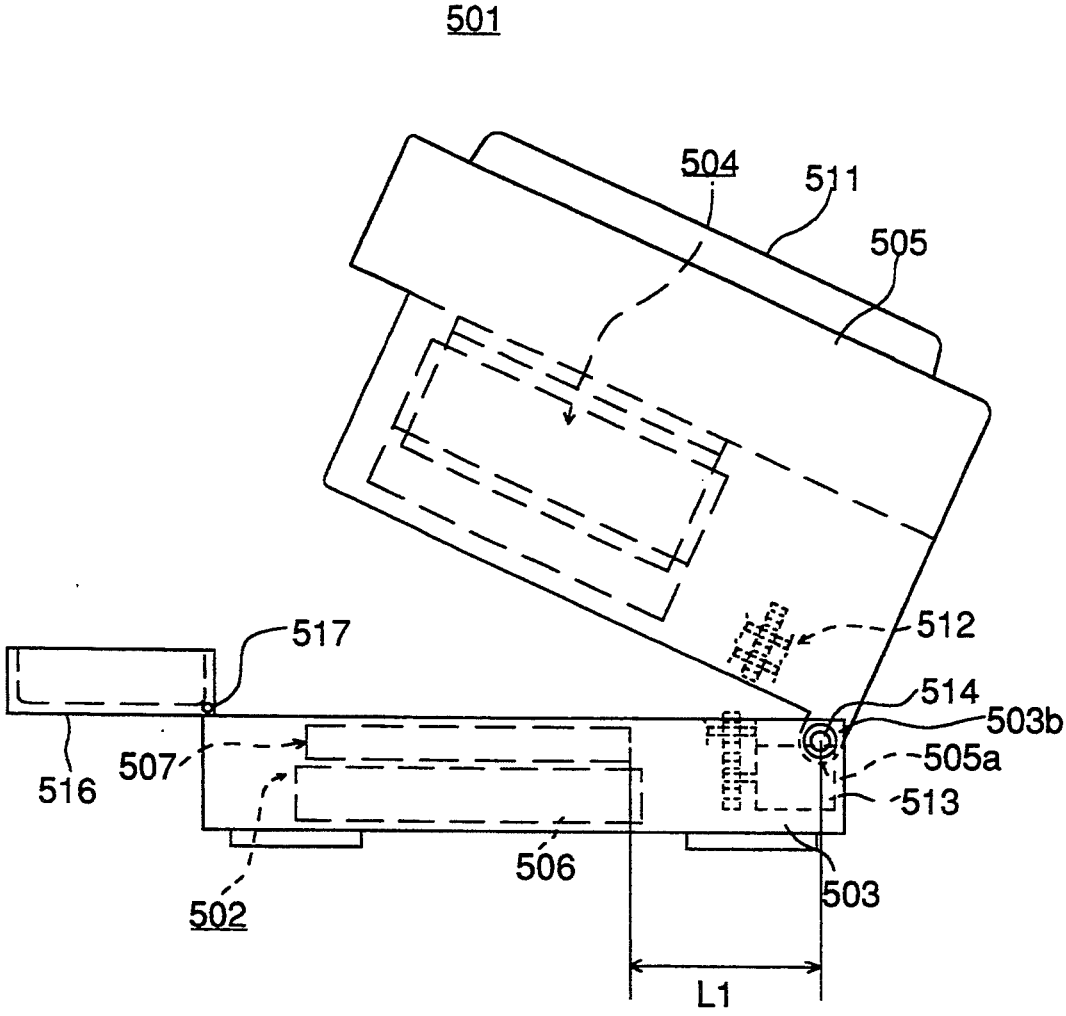
FIG. 2 is a right-hand side view showing another example of the image forming apparatus achieving the third object of the invention.
Figure 3:
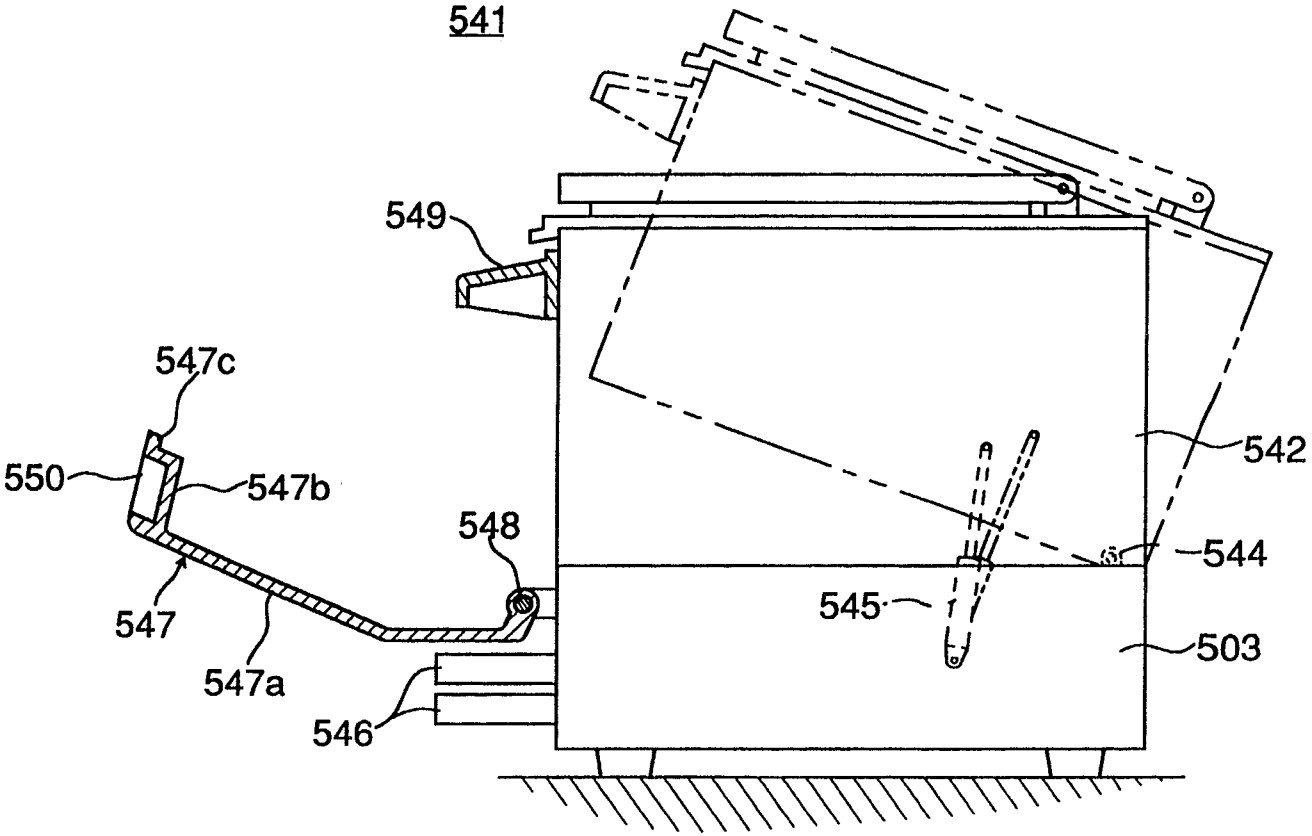
FIG. 3(*a*) and FIG. 4(*a*) show side views in which front doors are opened, and FIG. 3(*b*) and FIG. 4(*b*) show side views in which the front doors are closed.
Figure 3:
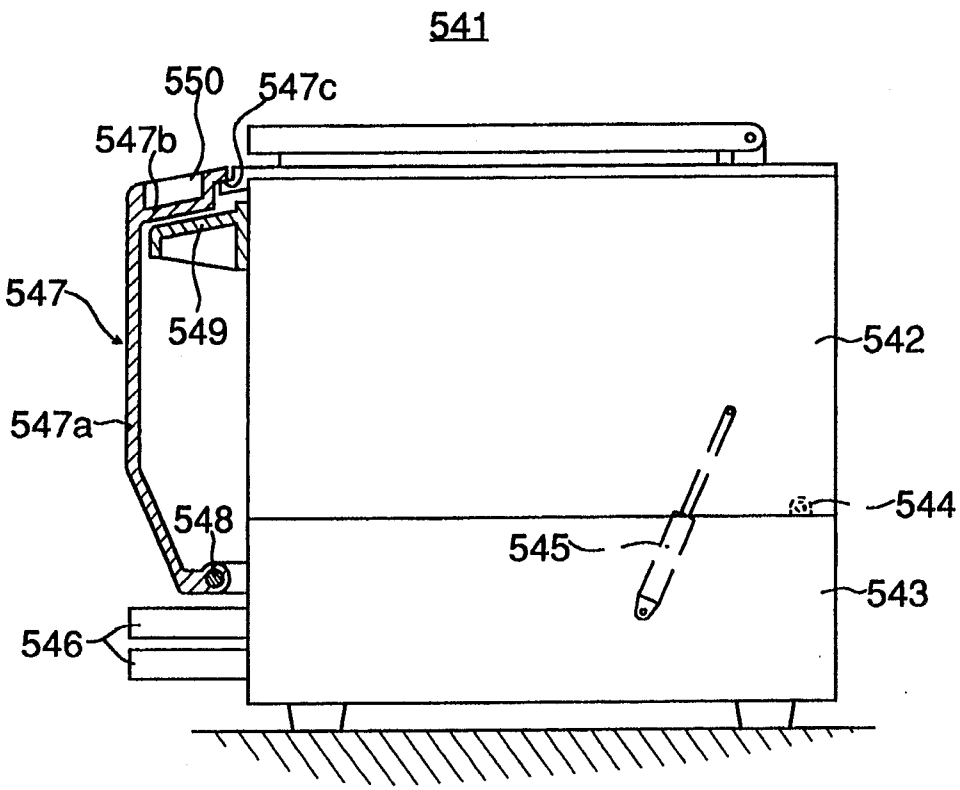

Examples of an image forming apparatus of the invention will be explained as follows, referring to the drawings. FIG. 1 represents a front view of an image forming apparatus achieving the third object of the invention, FIG. 2 represents a right-hand side view of the image forming apparatus in FIG. 1, and FIG. 3 is a right-hand side view showing the opened state of the image forming apparatus in FIG. 1.

Image forming apparatus 501 in FIG. 1 is composed of a lower half body 503 provided with device 502 built therein and upper half body 505 provided with device 504 built therein. The device 502 in the lower half body 503 consists of sheet feeding cassette 506 and sheet conveyance unit 507 that conveys sheets. A transfer sheet fed out of the sheet feeding cassette 506 is conveyed by the sheet conveyance unit 507 from the right side of the lower half body 503 to the left side thereof, and sheet conveyance path 508 that conveys a transfer sheet laterally is formed. The width of the sheet conveyance path 508 is equal to or greater than the maximum transfer sheet width so that a transfer sheet may be conveyed smoothly.

The device 504 in the upper half body 505 is composed of image forming process unit 510 that includes photoreceptor 509, and platen cover 511 is provided on the top of the upper half body 505.

The device 502 in the lower half body 503 and the device 504 in the upper half body 505 are linked through power linkage unit 512. The device 502 in the lower half body 503 is linked with the device 504 in the upper half body 505 by means of driving motor 513 provided on the lower half body 503. The driving motor 513 may also be provided on the upper half body 505 so that the device 502 in the lower half body 503 may be linked with the device 4 in the upper half body by means of the power linkage unit 512.

In the rear of the lower half body 503, there is formed supporting unit 503a on which the upper half body 505 is provided to be capable of opening and closing with supporting axis 514 running parallel with sheet conveyance path 508 as a fulcrum, and gas spring 515 is provided on the lower half body 503 so that the upper half body 505 may be urged upwards.

On the front side of the lower half body 503 opposite to the supporting axis 514 thereon, there is provided front door 516 covering the devices 502 and 504 respectively in the lower half body 503 and the upper half body 505 so that the front door 516 may open and close by means of hinge 517. Namely, the front door 516 is provided on one side of the sheet conveyance path 508 and the supporting axis 514 is provided on the other side thereof at the point of distance L1 from width W of the upper half body 505 is opened and closed with the supporting axis 514 as a fulcrum, and when the upper half body 505 is opened with the front door 516 opened, the entire upper portion of the sheet conveyance path 508 is opened to form a large space which makes it easy to clear jamming of transfer sheets.

The supporting axis 514 is provided at the upper position that is away from the sheet conveyance path 508 by L2 and from the power linkage unit 512 by L3, and thereby, the upper half body 505, when it is opened, does not jut out of the lower half body 503, resulting in no increase of floor space for an image forming apparatus 501.

Figure 4:
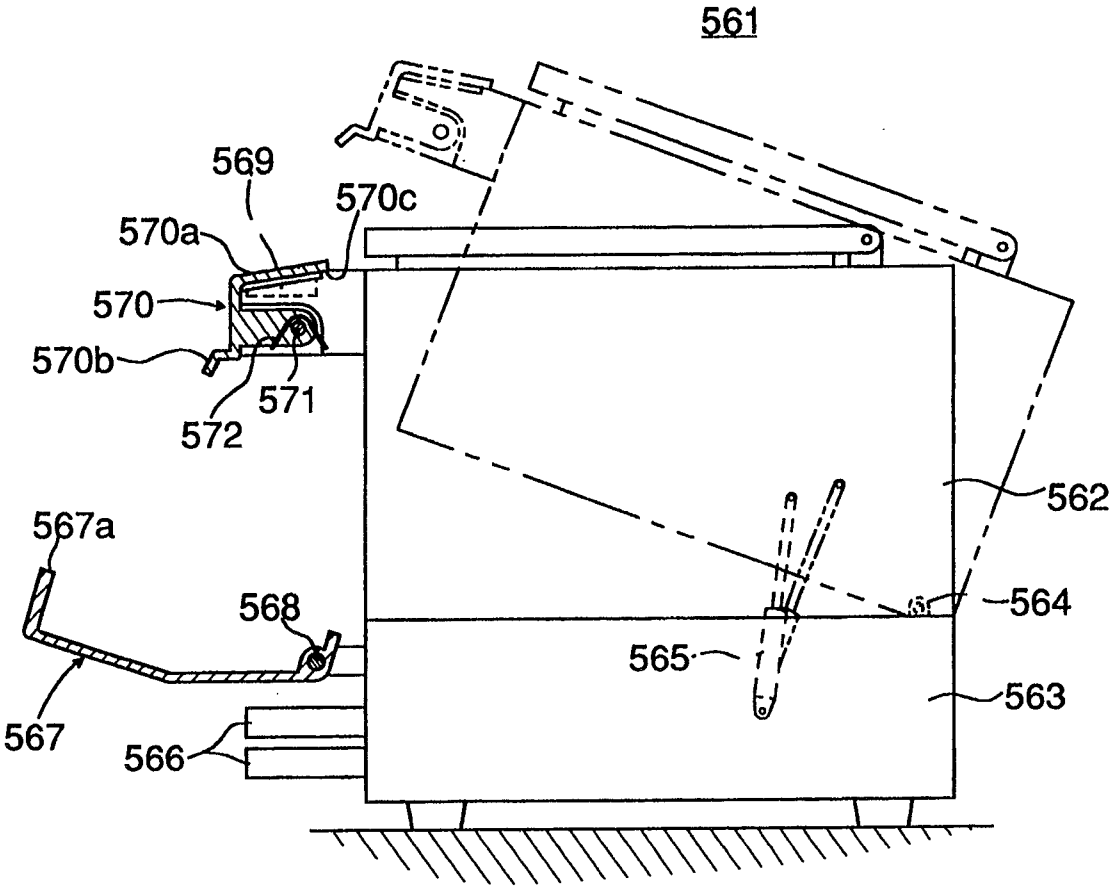
Figure 4:
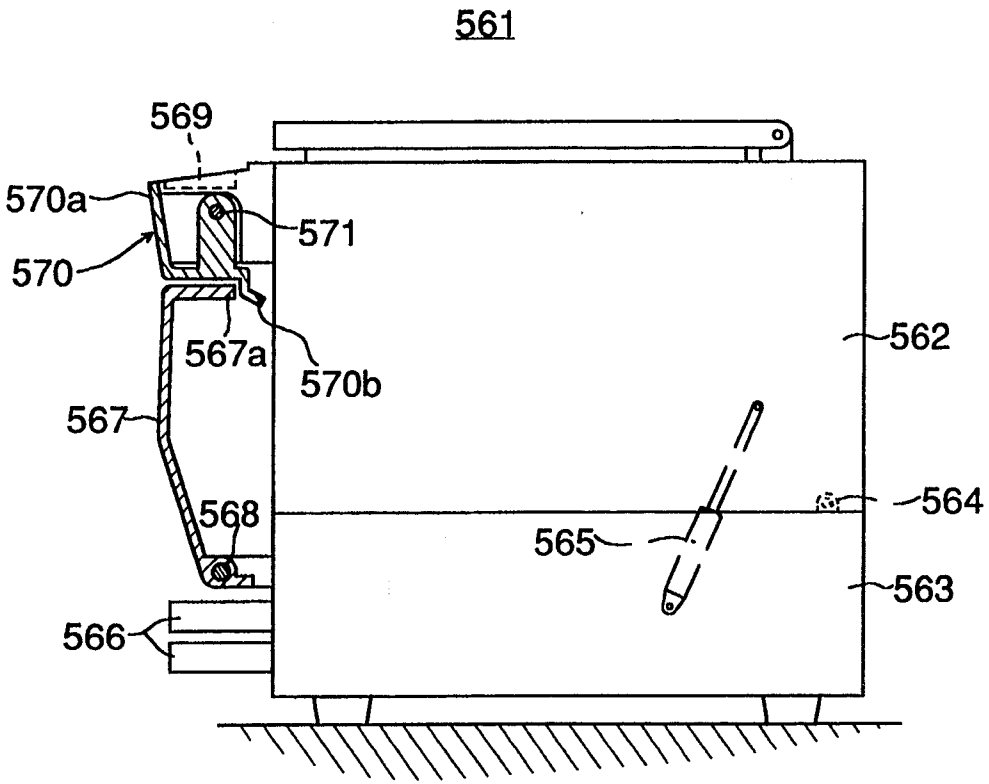

FIG. 4 is a right-hand side view showing another example of the image forming apparatus. In this example, lower end portion **505*a* of upper half body 505 is projected to be supported on upper end portion 503*b* by means of supporting axis 514. On one side of sheet conveyance path 8, there is provided front door 516, and at the point being away from width W of the sheet conveyance path 508 by distance L1 on the other side of the sheet conveyance path 508, there is provided supporting axis 514 around which the upper half body 505 is opened and closed. When the upper half body 505 is opened, the upper portion of the sheet conveyance path 508** is opened to form a large space which makes it easy to clear jamming of transfer sheets.

In the invention, as stated above, the front door is provided on one side of the sheet conveyance path, and the supporting axis around which the upper half body is opened and closed is provided at a the point being away from the width of the sheet conveyance path on the other side of the sheet conveyance path. When the upper half body is opened, therefore, the upper portion of the sheet conveyance path is opened to form a large space which makes it easy to clear jamming of transfer sheets.

The width of the sheet conveyance path is equal to or greater than the maximum transfer sheet width, which makes it possible to convey transfer sheets smoothly.

Since the front door is provided on one side of the sheet conveyance path and the supporting axis for opening and closing of the upper half body is provided at the position over the sheet conveyance path on the other side of the sheet conveyance path, it is possible to limit the amount of projection of the upper half body from the lower half body caused when the upper half body is opened, resulting in easy securing of the floor space of an apparatus.

Since the front door is provided on one side of the sheet conveyance path and the supporting axis for opening and closing of the upper half body is provided at the position over the power linkage unit on the other side of the sheet conveyance path, it is possible to limit the amount of projection of the upper half body from the lower half body caused when the upper half body is opened, resulting in easy securing of the floor space of an apparatus.

Next, constitution of a front cover and a front side of the upper half body will be explained.

In FIG. 3*a*, unillustrated image forming process units are provided in the upper half body 542, while in the lower half body 543, there is provided a sheet conveyance unit (not shown) for sheets fed out of sheet feeding cassette 546. In the course of image forming operation, the upper half body 542 is linked integrally with the lower half body by means of an unillustrated locking means.

On the lower half body 543, there is provided front cover 547 capable of opening and closing in the longitudinal direction through hinge 548 so that inspection and repair of units provided in both half bodies 542 and 543 can be conducted easily. When the upper half body is in its closed position, the front cover 547 covers a front side of the upper half body 542 linked with the lower half body 543 and protects each unit.

Therefore, opening of the upper half body 542 away from or closing thereof towards the lower half body 543 is conducted through operation of the aforementioned locking means with the front cover 547 opened.

At the upper portion on the front side of the upper half body 542, there is protruded pressing portion 549 that is pressed when the upper half body 542 is closed. On the front cover 547, there are provided front cover portion 547*a* that covers a front side of the upper half body 542 when the front cover 547 is closed and upper cover portion 547*b* that covers the upper surface of the pressing portion 549 are formed.

on the upper cover portion 547*b*, there are provided operating devices 550 for operating units in both half bodies 542 and 543, and the upper cover portion 547*b* causes its tip 547*c*, when the front cover 547 is closed, to engage with the upper surface on the front side of the upper half body 542 so that the operating devices 550 may be aligned continuously with the upper portion on the front side of the upper half body 542.

Owing to the constitution mentioned above, when the lock means is released by opening the front cover 547 for the occasion of inspection and repair of units in the upper and lower half bodies 542 and 543, a front portion of the upper half body 542 is opened by gas spring 545 with hinge 544 as a fulcrum.

When closing the upper half body 542 after the completion of the inspection and repair, the pressing portion 549 is pressed so that the upper half body 542 may press the lower half body 543 down to be linked integrally therewith by means of the locking means, and then the front cover 547 is closed.

When closing the upper half body 542, therefore, the operating devices 550 are not touched. Accordingly, there is no fear that erroneous operations and transformation of base boards in the operation devices are caused.

In the explanation of the example mentioned above, the rear end of the upper half body 542 and that of the lower half body 543 are hinged around hinge 544 so that they can be opened and closed. The invention, however, can also be applied to those wherein a side portion of the upper half body 542 and that of the lower half body 543 are hinged around hinge 544.

In the present example, as stated above, an image forming apparatus wherein an upper half body is provided to be opened away or closed towards a lower half body when a front cover is opened has thereon a pressing portion protruded on the front side of the upper half body for closing the upper half body, the front cover has thereon a front cover portion that covers the front side of the upper half body when the front cover is closed and an upper cover portion that covers the upper surface of the pressing portion, and the upper cover portion is provide thereon operating devices. Therefore, when the upper half body is closed, the pressing portion is pressed for closing of the upper half body and the front cover covers the front side of the upper half body and the top surface of the pressing portion. This means that it is possible to close the upper half body without touching the operating devices, resulting in no fear that erroneous operations and transformation of base boards in the operation devices are caused.

Next, another example relating to the constitution of a front cover and a front side of the upper half body will be explained. In FIG. 4*a*, at the upper portion on the front side of upper half body 562, there are provided operating devices 569 which are for the units arranged in the upper and lower half bodies 562 and 563. Cover member 570 that covers operating devices 569 is hinged by hinge 571 on the front side of the upper half body 562 so that it may pivot in front of the upper half body 562, and the cover member 570 is constantly urged toward the upper surface of the upper half body 562 by spring 572 hooked on the hinge 571.

On the cover member 570, there are formed cover portion 570*a* that covers the operating devices 569 when the cover member 570 pivots toward the upper surface of the upper half body 562 and engaging portion 570*b* that engages with tip 567*a* of the front cover 567 to rotate the cover portion 570*a* toward the front side of the upper half body 562 when the front cover closes.

Further, edge 570*c* of the cover portion 570*a* is formed to have the length which makes the edge 570*c* to touch the enclosure surface located at the rear of the operating devices 569 on the top of the upper half body 562 when the cover portion 570*a* covers the operating devices 569.

Owing to the constitution mentioned above, when the front cover 567 is opened for the purpose of inspection and repair of units provided in both the upper and lower half bodies 562 and 563, the cover member 570 pivots, being urged by the spring 572, toward the upper surface of the upper half body 572 and thereby the cover portion 570*a* can cover the operating devices 569.

When a locking mechanism is released under the state mentioned above, the front portion of the upper half body 562 is opened by gas spring 565 with hinge 564 as a fulcrum.

For closing the upper half body 562 after completion of the inspection and repair, the cover portion 570*a* is to be pushed down to press the upper half body 562 against the lower half body 563 so that both of them may be connected integrally by the locking mechanism, and then the front cover 567 is to be closed.

When the front cover 567 is closed, the tip 567*a* of the front cover 567 engages with engaging portion 570*b* of the cover member 570, and thereby the cover member 570 pivots toward the front of the upper half body 562 to cause the cover portion 570*a* to retreat toward the front of the upper half body 562 to disclose the operating devices 569.

When closing the upper half body 562, therefore, the operating devices 569 are not touched. Accordingly, there is no fear that erroneous operation or transformation of a circuit-bearing substrate takes place.

In the explanation of the example mentioned above, the rear end of the upper half body 562 and that of the lower half body 563 are hinged around hinge 564 so that they can be opened and closed. The invention, however, can also be applied to those wherein a side portion of the upper half body 562 and that of the lower half body 563 are hinged around hinge 564.

In the invention, as stated above, an upper half body and a lower half body are provided so that the upper half body can be opened away from or closed towards the lower half body, a cover member that covers operating devices provided on the top at the front of the upper half body is supported pivotally on the front side of the upper half body, a spring that urges the cover member toward the upper surface of the upper half body is provided, and a cover portion that covers the operating devices when a front cover is opened as well as an engaging portion that engages with an edge of the front cover to cause the cover member to retreat toward the front of the upper half body when the front cover is closed are formed on the cover member. Therefore, when the front cover is opened, urging force of the spring causes the cover member to pivot and thereby to cover the operating devices, while when the front cover is closed, a tip of the front cover engages with an engaging portion of the cover member to cause the cover member to pivot toward the front of the upper half body and thereby to cause the cover portion to retreat toward the front of the upper half body to disclose the operating devices.

When closing the upper half body, therefore, the operating devices are not touched because the cover portion is pushed down for closing. Accordingly, there is no fear that erroneous operation or transformation of a circuit-bearing substrate takes place.

Figure 5:
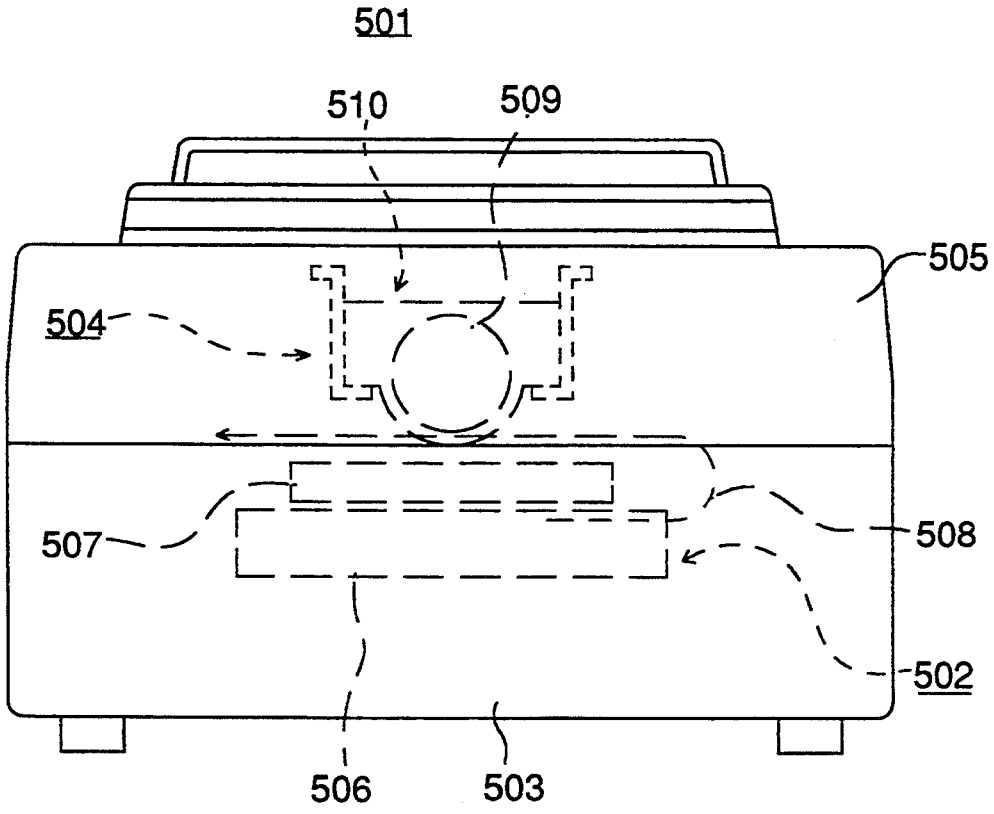
FIG. 5 is a front view of an image forming apparatus achieving the first object of the invention.
Figure 6:
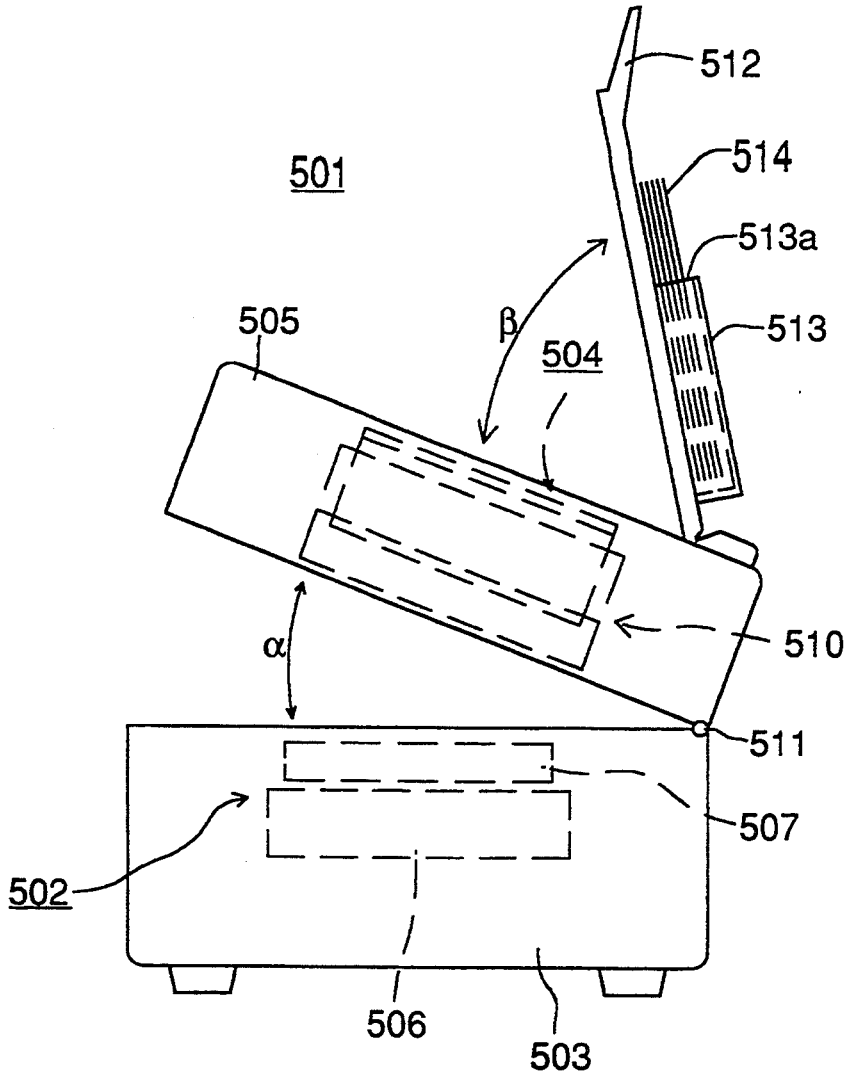
FIG. 6 is a right-hand side view of the image forming apparatus in FIG. 5

Examples of an image forming apparatus of the invention achieving the first object of the invention will be explained as follows, referring to the drawings. FIG. 5 is a front view of an image forming apparatus and FIG. 6 is a right-hand side view of the image forming apparatus in FIG. 5.

Image forming apparatus 501 in FIG. 1 is composed of a lower half body 503 provided with device 502 built therein and upper half body 505 provided with device 504 built therein. The device 502 in the lower half body 503 consists mainly of sheet conveyance unit 507 that conveys transfer sheets fed out of sheet feeding cassette 506, and a sheet fed out of the sheet feeding cassette 506 is conveyed by the sheet conveyance unit 507 from the right side to the left side of the lower half body 503, and sheet conveyance path 508 is formed laterally.

The device 504 in the upper half body 505 is composed mainly of image forming process unit 10 having therein photoreceptor 509, and the upper half body 505 is provided to be capable of opening away from or closing towards the lower half body 503 with supporting axis 511 running parallel with sheet conveyance path 508 as a fulcrum. When the upper half body 505 is opened, the entire portion above the sheet conveyance path 508 is opened to form a large space. The upper half body 505 is arranged to be opened away from the lower half body 503 by opening angle $\alpha$.

On the top of the upper half body 505, there is provided platen cover 512 which is capable of opening and closing in the direction identical to that for the upper half body 505 and is provided with document acceptor 513 having opening 513*a* at its opening side. Document 514 is placed on the document acceptor 513. The platen cover 512 is set so that it can be opened away from the upper half body 505 by opening angle $\beta$.

The sum of the opening angle $\alpha$ between the upper half body 505 and the lower half body 503 and the opening angle $\beta$ between the upper half body 505 and platen cover 512 is established to be not more than 90 degrees. In the case, for example, of maintenance service or the like, therefore, even when the platen cover 512 is further opened away from the upper half body 505 under the condition that the upper half body 505 is opened away from the lower half body 503, it does not happen that document 514 positioned on document acceptor 513 falls on the side opposite to the opening direction of the platen cover 512 or pages of the document are turned.

Figure 7:
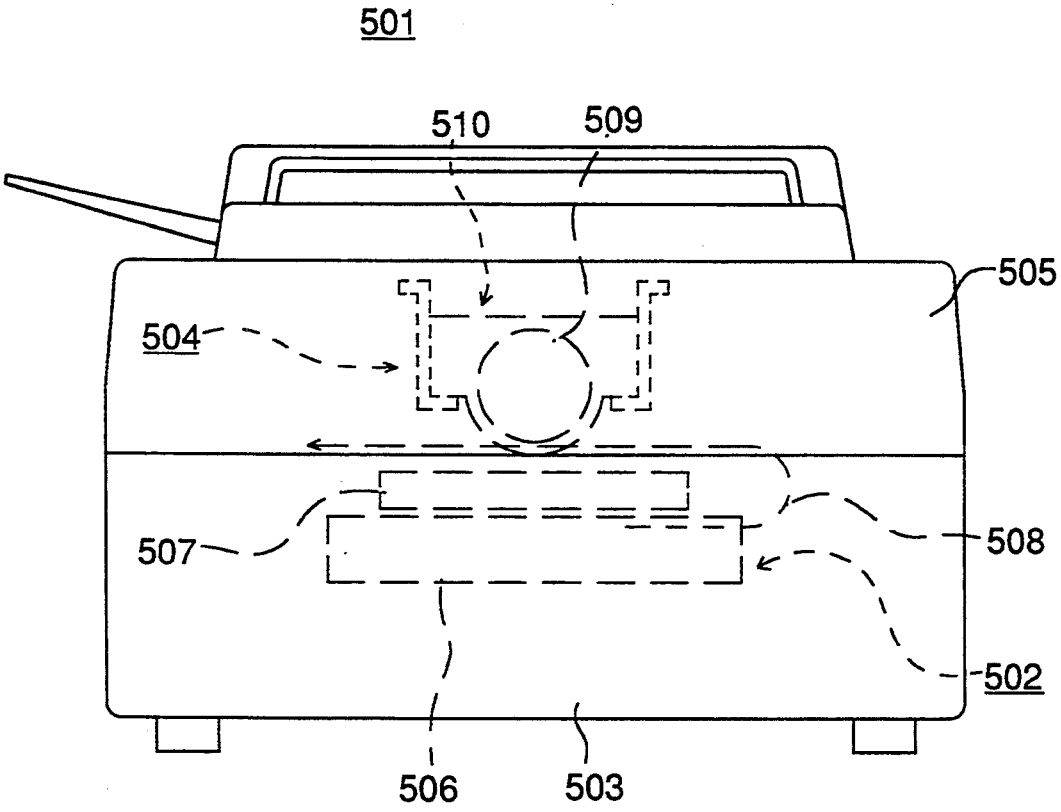
FIG. 7 is a front view of the image forming apparatus achieving the first object of the invention.
Figure 8:
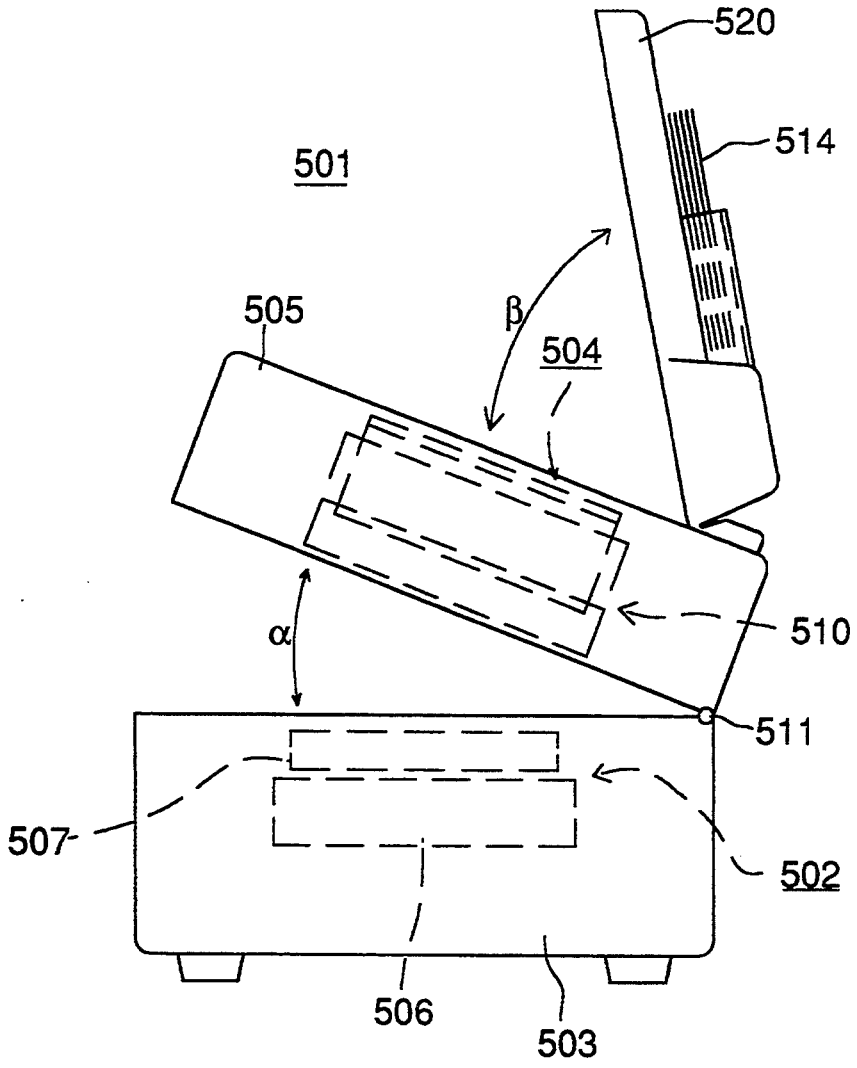
FIG. 8 is a right-hand side view of the image forming apparatus in FIG. 7.

FIGS. 3 and 4 represent other examples of an image forming apparatus achieving the first object of the invention, FIG. 7 is a front view of the image forming apparatus and FIG. 8 is a right-hand side view of the image forming apparatus in FIG. 7.

The image forming apparatus 501 comprises lower half body 503 provided with device 502 built therein and upper half body 505 provided with device 504 built therein, and explanation of them will be omitted because they are arranged similarly to those in the example mentioned above and are given the same symbols as those in the aforementioned example.

On top of the upper half body 505, there is provided automatic document feeder 520 which is capable of being opened and closed in the same direction as that for the upper half body 505 and is set to be opened up to opening angle $\beta$. The sum of the opening angle $\alpha$ between the upper half body 505 and the lower half body 503 and the opening angle $\beta$ between the upper half body 505 and the automatic document feeder 520 is established to be not more than 90 degrees. In the case, for example, of maintenance service or the like, therefore, even when the automatic document feeder 520 is further opened away the upper half body 505 under the condition that the upper half body 505 is opened away from the lower half body 503, the apparatus main body is prevented from being tumbled down, and it is prevented that document 514 positioned on the automatic document feeder 520 falls on the side opposite to the opening direction of the automatic document feeder 520 or pages of the document are turned on the occasion that the apparatus is not tumbled down.

As stated above, the sum of the opening angle between the upper half body and the lower half body and the opening angle between the upper half body and the platen cover is established to be not more than 90 degrees. In the case, for example, of maintenance service or the like, therefore, even when the platen cover is further opened away from the upper half body under the condition that the upper half body is opened away from the lower half body, it is prevented that the document positioned in a document acceptor falls on the side opposite to the opening direction of the platen cover, or pages of the document are turned.

The sum of the opening angle between the upper half body and the lower half body and the opening angle between the upper half body and the automatic document feeder is established to be not more than 90 degrees. Therefore, in the case, for example, of maintenance service or the like, even when the automatic document feeder is further opened away from the upper half body under the condition that the upper half body is opened away from the lower half body, the apparatus main body is prevented from being tumbled down, and it is prevented that document positioned on the automatic document feeder falls on the side opposite to the opening direction of the automatic document feeder or pages of the document are turned on the occasion that the apparatus is not tumbled down.

Further, the upper half body can be opened away and closed towards the lower half body with a supporting axis running parallel with a sheet conveyance path as a fulcrum. Therefore, even if an opening angle of the upper half body against the lower half body is set to be small, entire upper portion of the sheet conveyance path can be opened to form a large space which makes it easy to clear jamming.

Examples of an image forming apparatus achieving the second object of the invention will be explained as follows, referring to the drawings attached hereto. The first example will be explained in the first place, referring to FIGS. 9–11. In this case, FIG. 9 is a left-hand side view of the image forming apparatus, FIG. 10 is a front view thereof and FIG. 11 is a left-hand side view showing the opened state of the image forming apparatus.

Figure 9:
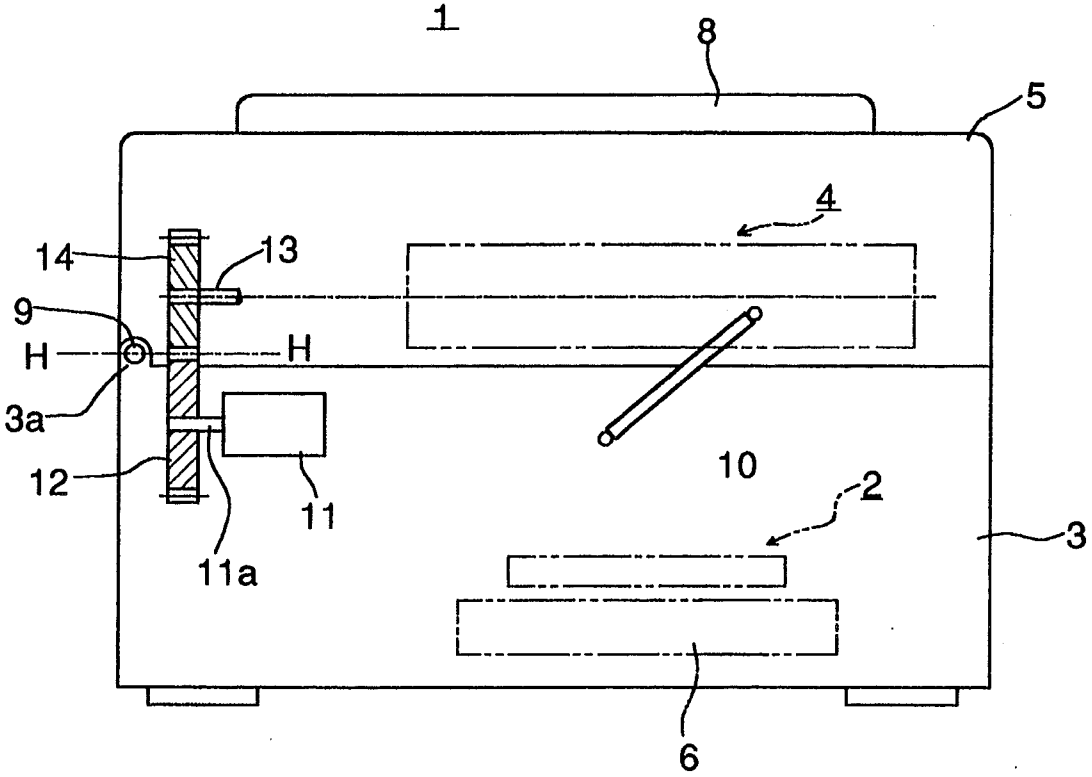
FIG. 9 is a left-hand side view of an image forming apparatus of the first example achieving the second object of the invention.
Figure 10:
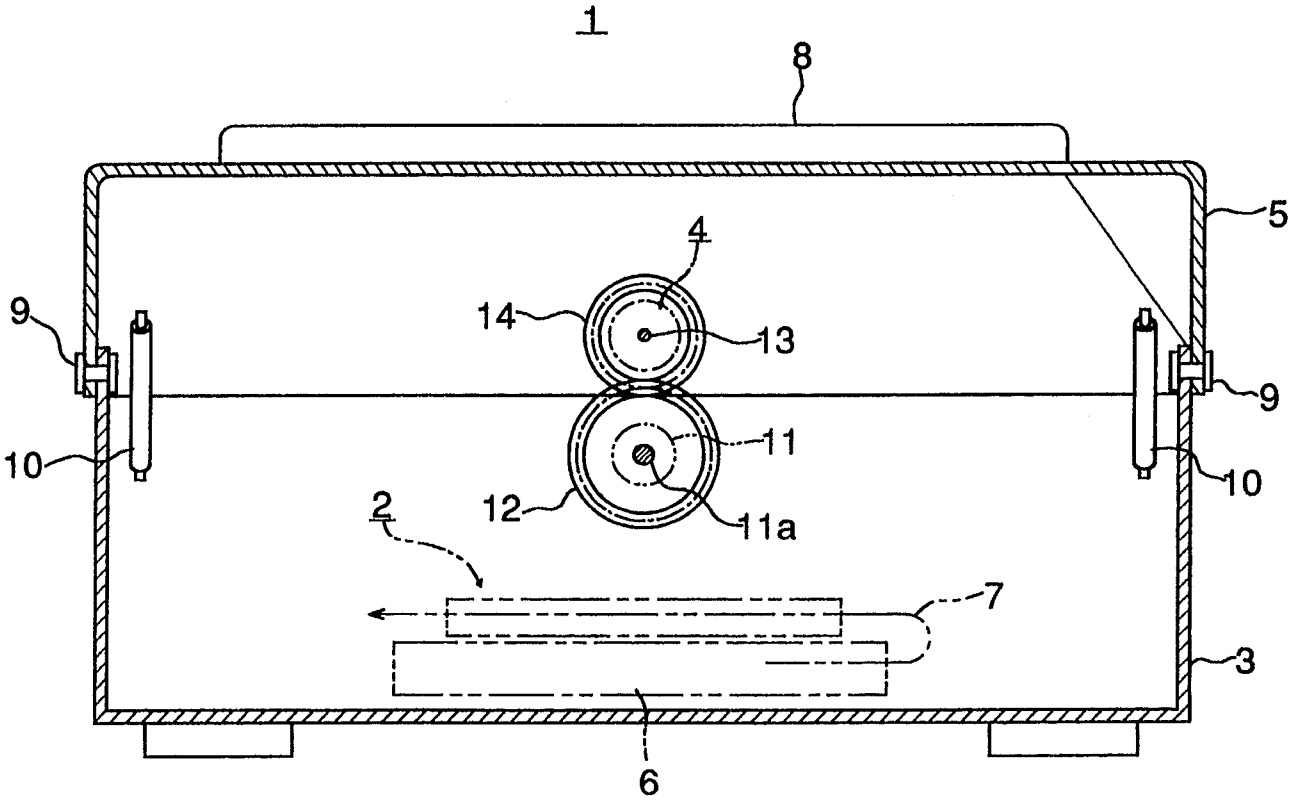
FIG. 10 is a front view of the image forming apparatus in FIG. 9.
Figure 11:
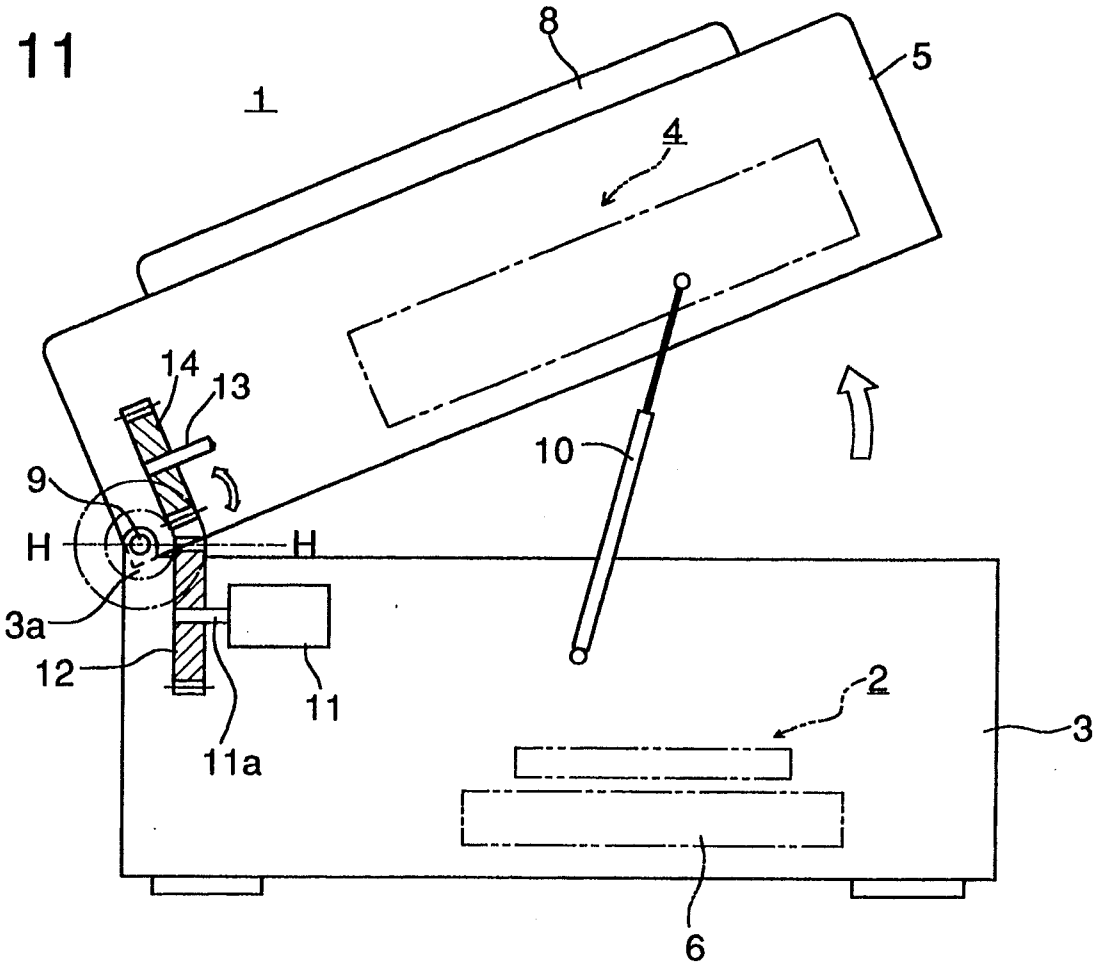
FIG. 11 is a left-hand side view showing the opened state of the image forming apparatus in FIG. 9.

The image forming apparatus 1 comprises lower half body 3 provided with device 2 built therein and upper half body 5 provided with device 4 built therein, as shown in FIGS. 9 and 10. The device 2 in the lower half body 3 is mainly composed of a sheet conveyance unit for sheet materials fed out of sheet feeding cassette 6, wherein a sheet material taken out of the sheet feeding cassette 6 is conveyed by the conveyance unit from the right side of the lower half body 3 to the left side thereof, and sheet material conveyance path 7 is formed laterally. The device 4 in the upper half body 5 is composed mainly of an image forming process unit including a photoreceptor, and platen 8 is provided on top of the upper half body 5.

In the rear of the lower half body 3, there is formed supporting unit **3*a* on which the upper half body 5 is provided to be capable of opening and closing with supporting axis 9 running parallel with sheet material conveyance path 7 as a fulcrum, and an urging member such as gas spring 10 or the like is provided between the lower half body 3 and the upper half body 5. Therefore, when sheet jamming or the like takes place, a front portion of the upper half body 5 is lifted to a predetermined position as shown in FIG. 11 so that the upper half body 5 may swing. The swung position of the upper half body 5 is held by elasticity of the gas spring 10**.

AC motor 11 is provided on the lower half body 3 as a driving source, and driving gear 12 is affixed on driving shaft 11a of the AC motor 11. In the upper half body 5, on the other hand, driven gear 14 is affixed on output shaft 13 for rotating photoreceptor drum or the like in the device, and the driven gear 14 engages with the driving gear 12 when the upper half body 5 is closed. The point of engagement H—H between the driven gear 14 and the driving gear 12 is the same as the supporting shaft 9 in height.

The movement of the driven gear 14 made in the course of opening and closing of the upper half body 5 will be explained as follows, referring to FIG. 11. When the upper half body 5 is opened, the driven gear 14 pivots along a circular arc whose center is the supporting axis 9. A locus of engagement points of the driven gear 14 passes along a circle shown with chain lines in FIG. 11. Namely, the pivoting locus of engagement points of the driven gear 14 starts from the point that is on the level of the supporting shaft. Therefore, the driven gear 14 starts engaging with the driving gear 12 vertically when the upper half body 5 is closed. This results in constitution wherein the gear in the upper half body starts engaging with or disengaging from the gear in the lower half body vertically, similarly to the occasion of an image forming apparatus of a lateral-opening clamshell type wherein the upper half body is opened and closed with an output shaft moved in parallel with a driving shaft, thus, resulting in elimination of improper engagement or interfering engagement caused by mutual interference of sides of gear tips.

Figure 12:
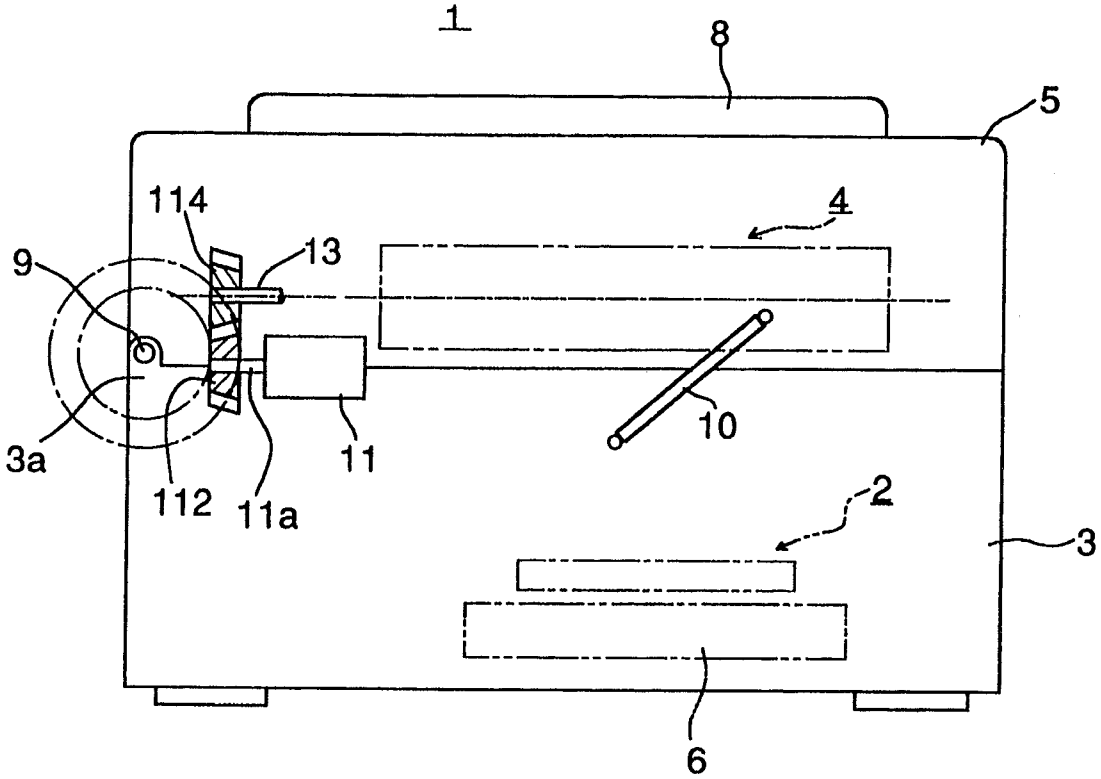
FIG. 12 is a left-hand side view of an image forming apparatus of the second example achieving the second object of the invention.
Figure 13:
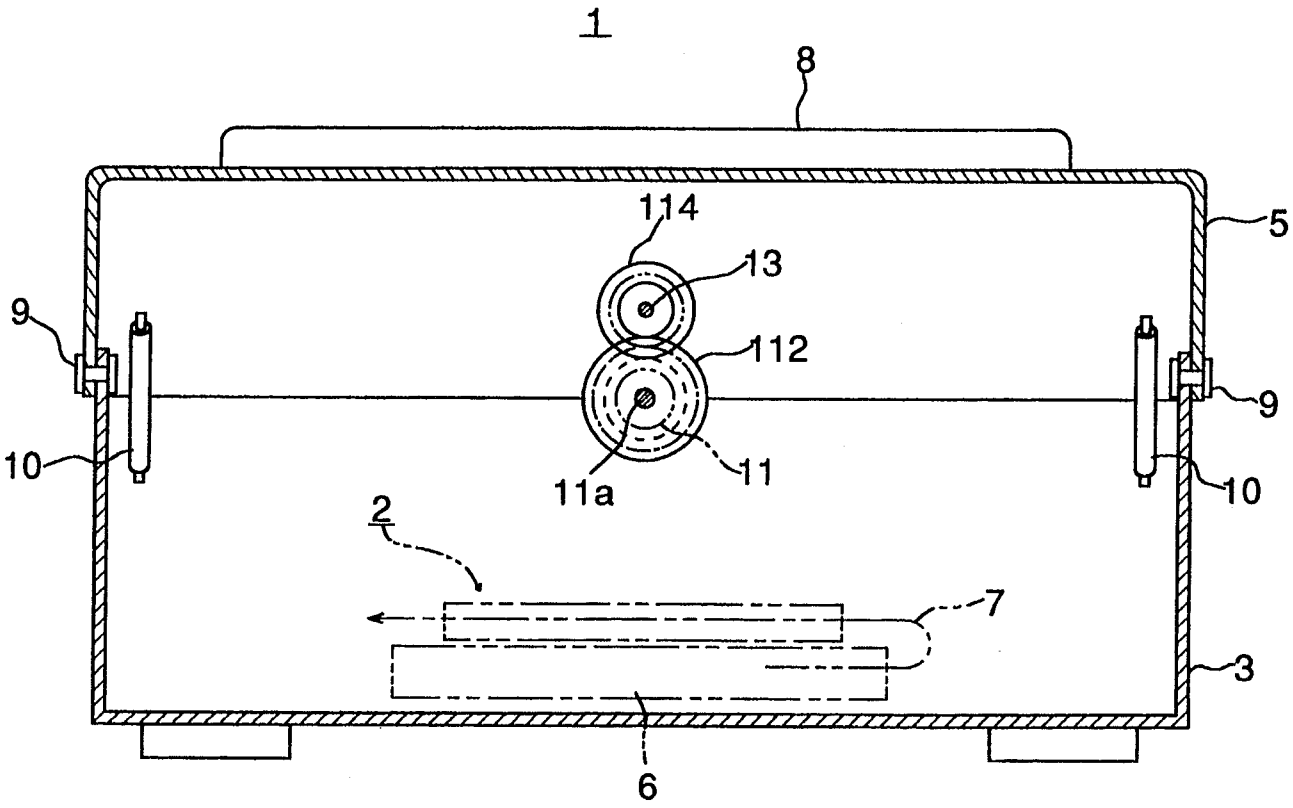
FIG. 13 is a front view of the image forming apparatus in FIG. 12.
Figure 14:
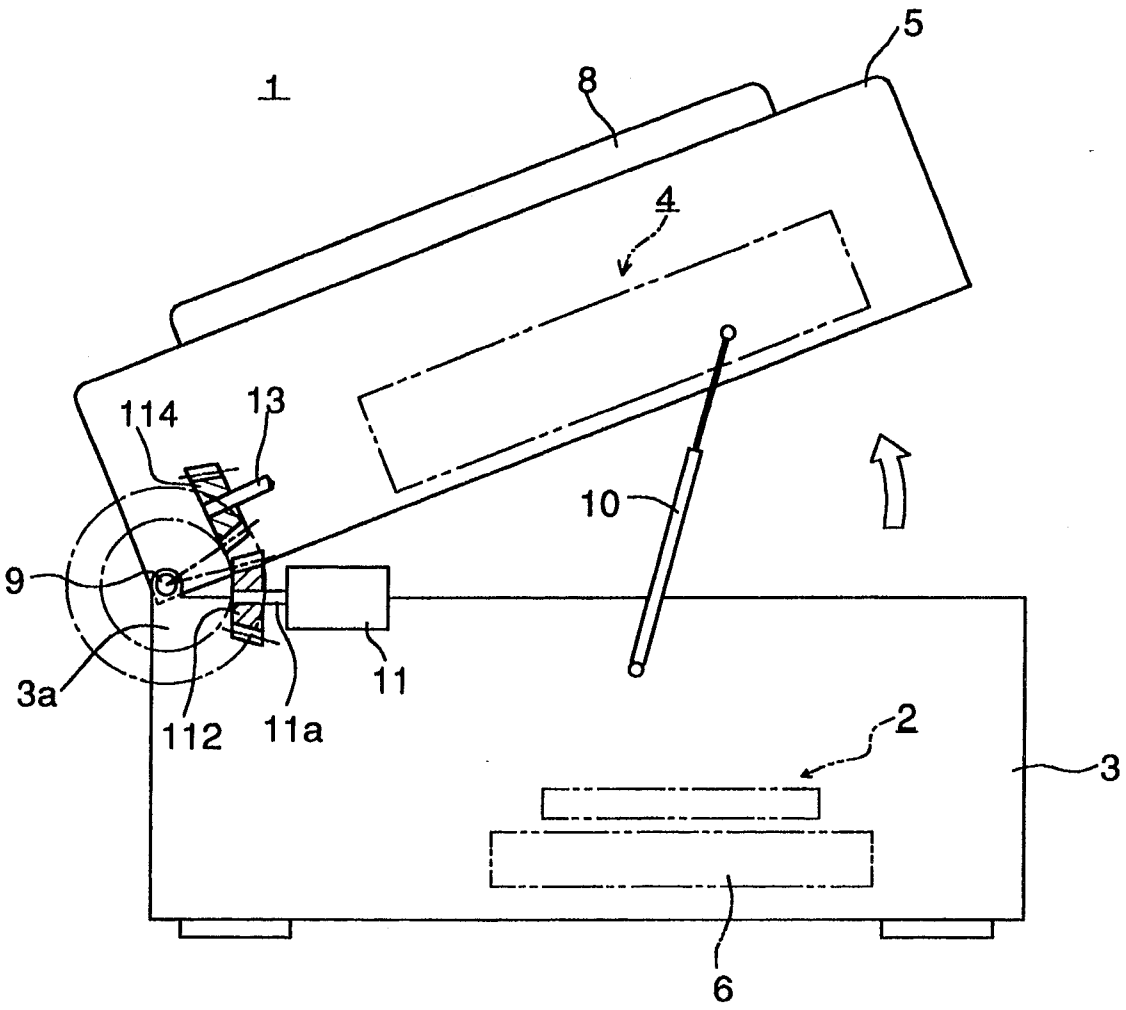
FIG. 14 is a left-hand side view showing the opened state of the image forming apparatus in FIG. 12.

The second example will be explained next, referring to FIGS. 12–14. In this case, FIG. 12 is a left-hand side view of an image forming apparatus, FIG. 13 is a front view thereof and FIG. 14 is a left-hand side view showing the opened state of the image forming apparatus. Detailed explanation for symbols in each figure which are identical to those in FIGS. 9–11 will be omitted, because they are the same in structure and action as those in FIGS. 9–11.

There is affixed driving bevel gear 112 on driving shaft **11*a* of AC motor 11 in lower half body 503. On output shaft 13 in upper half body 5, on the other hand, there is affixed driven bevel gear 114 which engages with the driving bevel gear 112 when the upper half body 5 closes. A plane of engagement between the driven bevel gear 114 and the driving bevel gear 112 is in the direction of a radius of a circular arc whose center is supporting axis 9. In this case again, when the upper half body 5 is opened, the driven bevel gear 114 pivots along a circular arc having its center at supporting axis 9, but an engagement portion of the driven gear 14 agrees always with the direction of a radius of the circular arc. Therefore, the driven gear 114 does not approach the driving bevel gear 112** from the side thereof for engagement. Accordingly, it results in constitution wherein the gear in the upper half body starts engaging with or disengaging from the gear in the lower half body vertically, similarly to the example mentioned above, resulting in elimination of improper engagement or interfering engagement caused by mutual interference of sides of gear tips.

Figure 15:
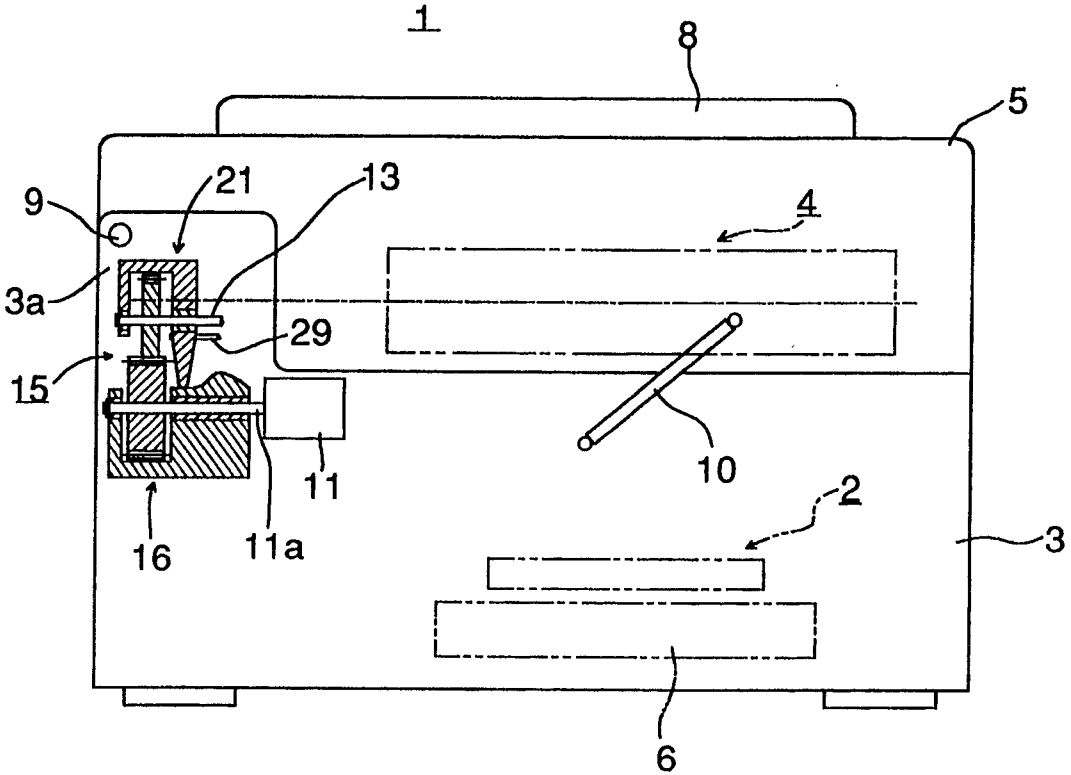
FIG. 15 is a left-hand side view of an image forming apparatus of the third example achieving the second object of the invention.
Figure 16:
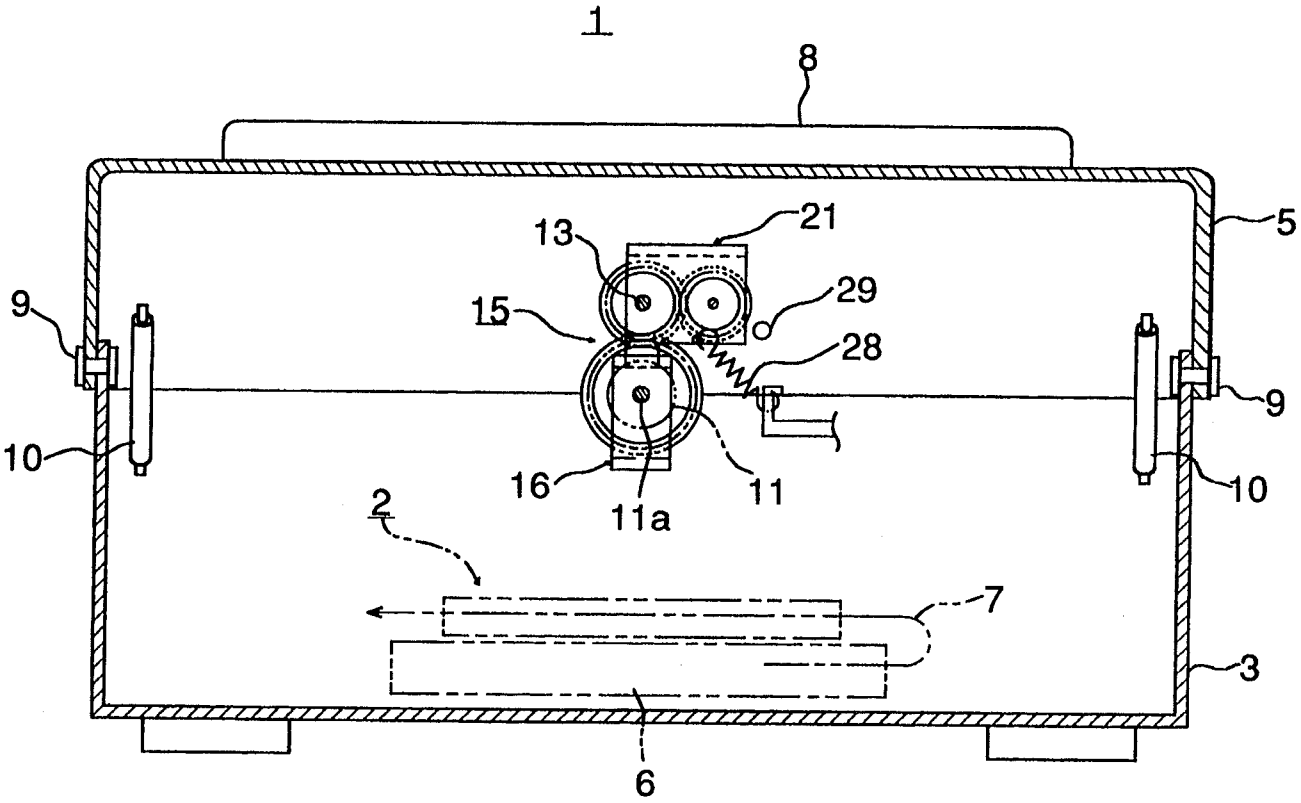
FIG. 16 is a front view of the image forming apparatus in FIG. 15.
Figure 17:
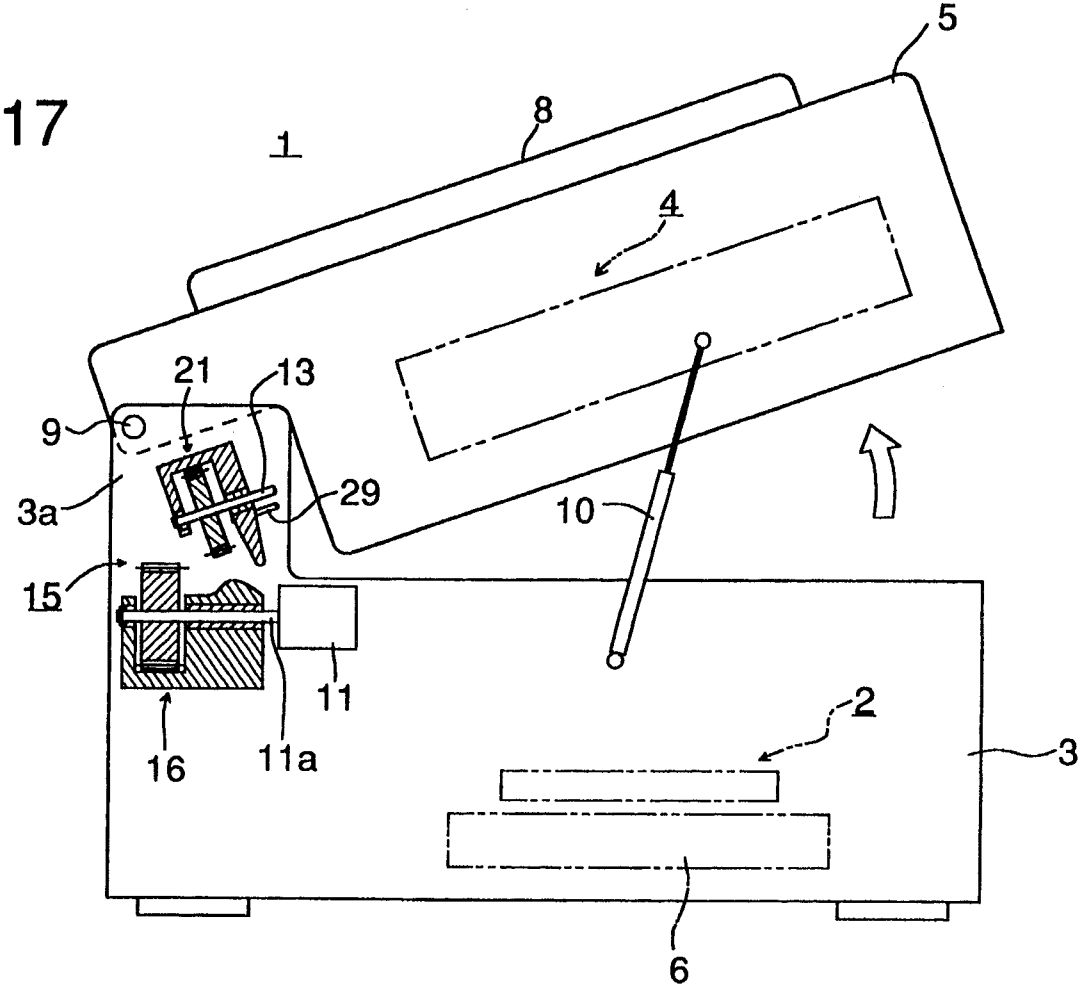
FIG. 17 is a left-hand side view showing the opened state of the image forming apparatus in FIG. 15.
Figure 18:
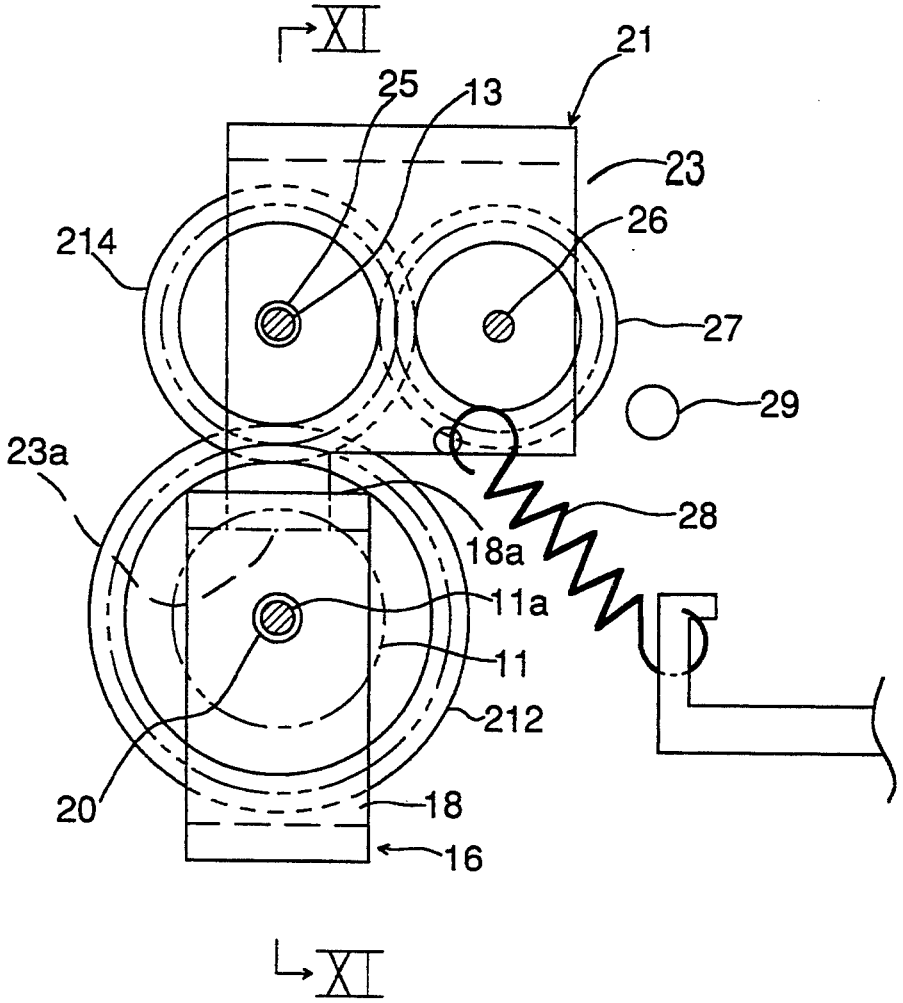
FIG. 18 is a front view of a torque transmission device and FIG. 19 is a sectional view showing a section taken on line XI—XI in FIG. 18.
Figure 19:
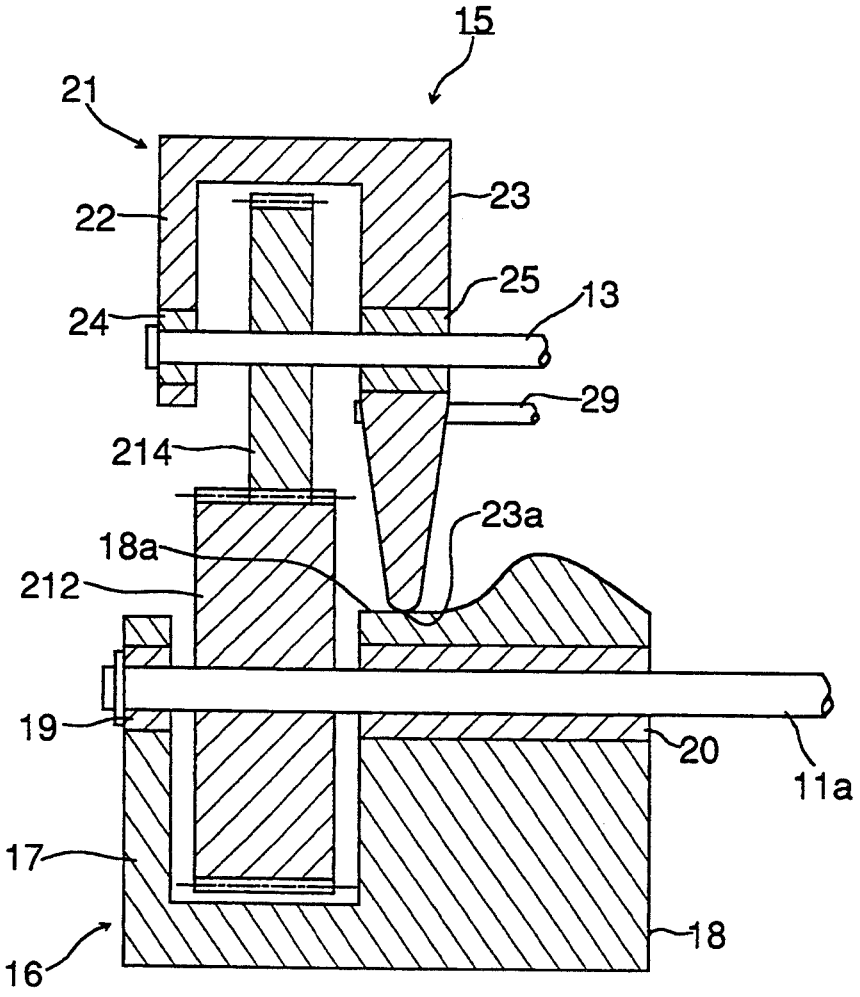
Figure 20:
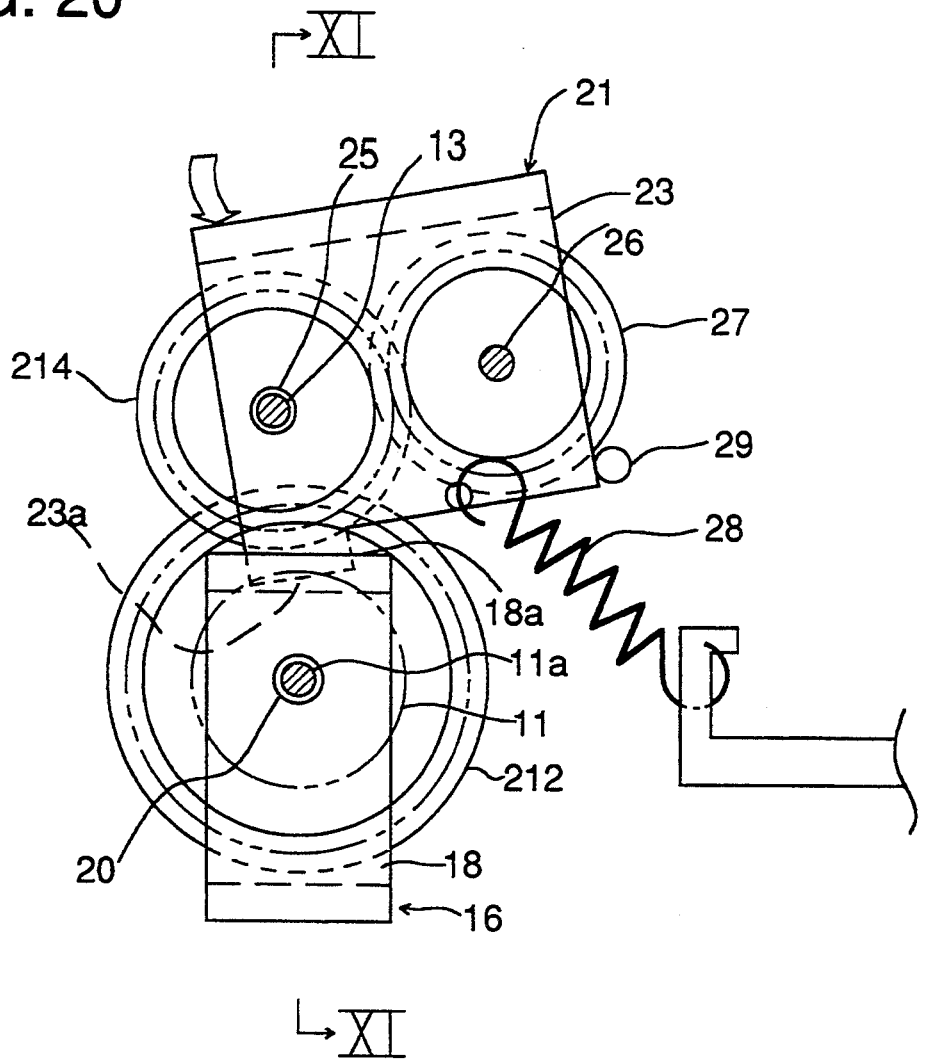
FIG. 20 is a front view showing the actions of the torque transmission device in the course of the opening of the upper half body and FIG. 21 is a sectional view showing a section taken on line XIII—XIII in FIG. 20.
Figure 21:
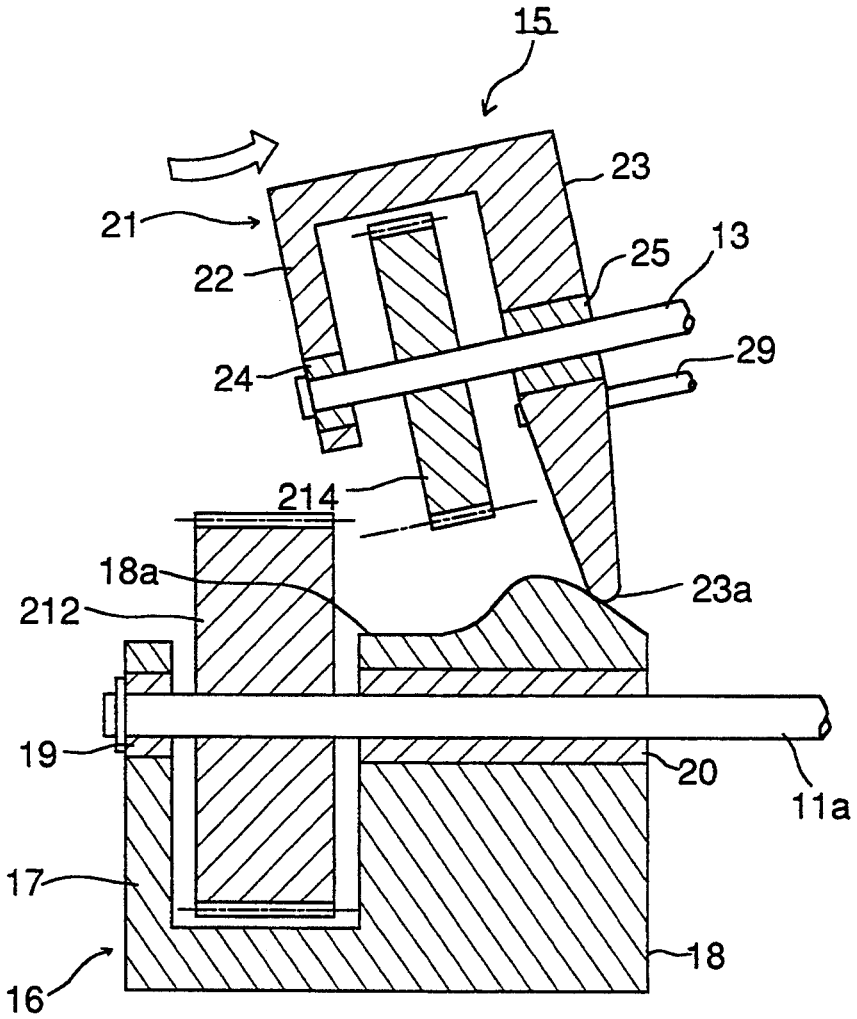

The third example will be explained next, referring to FIGS. 15–21. In this case, FIG. 15 is a left-hand side view of an image forming apparatus, FIG. 16 is a front view thereof and FIG. 17 is a left-hand side view showing the opened state of the image forming apparatus. FIG. 18 is a front view of a torque-transmission device, FIG. 19 is a sectional view showing a section taken on line XI—XI in FIG. 18, FIG. 20 is a front view showing the action of the torque-transmission device performed when the upper half body is opened, and FIG. 21 is a sectional view showing a section taken on line XIII—XIII in FIG. 20. Detailed explanation for symbols in each figure which are identical to those in FIGS. 9–11 will be omitted, because they are the same in structure and action as those in FIGS. 9–11.

On driving shaft 11*a* of AC motor 11 in lower half body 3 of image forming apparatus 1, there is affixed driving gear 212 that constitutes a driving side of torque-transmission device 15. On output shaft 13 in upper half body 5, on the other hand, there is affixed driven gear 214 that constitutes an output side and engages with the driving gear 212 when the upper half body 5 is closed.

As shown in FIG. 19, the driving shaft 11a on which the driving gear 212 is affixed is supported rotatably by journals 19 and 20 which respectively pass through and are provided in side plates 17 and 18 of lower gear supporting member 16 having a U-shaped section. Further, the output shaft 13 on which the driven gear 214 is affixed is supported rotatably by journals 24 and 25 which respectively pass through and are provided in side plates 22 and 23 of upper gear supporting member 21 having a U-shaped section.

The upper gear supporting member 21 is positioned so that it faces the lower gear supporting member 16, and tip 23*a* of the side plate 23 of the upper gear supporting member 21 located at the opening side of the upper half body 5 touches tip 18*a* of the side plate 18 of the lower gear supporting member 16 when the upper half body 5 is closed. The tip 18*a* forms a cam having a section of a smooth convex form, and the tip 23*a* of the upper gear supporting meter 21 that touches the bottom of the cam mentioned above when the upper half body 5 is closed forms a cam follower that moves vertically while sliding on the peripheral surface of the cam when the upper half body is opened.

As shown in FIG. 18, the upper gear supporting member 21 is connected to the upper half body 5 through shaft member 26 affixed on the upper half body 5. On the shaft member 26, there is supported idle gear 27 that engages with the driven gear 214, and spring member 28 whose one end is hooked on the upper half body 5 is hooked on the side plate 23. The spring member 28 is constantly urging the upper gear supporting member 23 to rotate with the shaft member 26 as a rotation center. In the vicinity of the side plate 23 in the direction of the rotation, there is provided stopper 29.

Actions of the upper gear supporting member 23 performed when the upper half body B opens and closes will be explained next, referring to FIGS. 17, 20 and 21. When the upper half body 5 is opened, the upper gear supporting member 23 pivots along a circular arc having its center at supporting axis 9. However, since the upper gear supporting member 23 is so arranged as to be capable of pivoting with the shaft member 26 as a rotation center as stated above, the tip 23*a* of the side plate 23 that is a cam follower pivots while moving vertically along the peripheral surface of the cam formed on the lower gear supporting member 16. After that, when the upper gear supporting member 23 leaves the lower gear supporting member 16, the cam follower is freed. However, the side plate 23 hits the stopper 29 as shown in FIG. 20. Therefore, the rotation of the upper gear supporting member 23 around the shaft member 26 is stopped.

When the upper half body 5 is closed, actions reverse in order to the above are taken, namely, the cam follower on the upper gear supporting member 23 touches the cam and is lifted upward along the peripheral surface of the cam. In this case, the cam follower receives a component force opposing elastic force of the spring member 28. Therefore, the upper gear supporting member 23 rotates reversely with the shaft member 26 as a rotation center, and a convex portion of the cam causes the driven gear 214 to be above the driving gear 212. Further, when the cam follower moves to the bottom of the cam, the upper gear supporting member 21 falls to cause the driven gear 214 to engage with the driving gear 212. When tips of upper and lower gears hit each other, the tip of the driven gear 214 is adjusted in position for proper engagement, because torque is applied on the driven gear 214 to rotate it around the shaft member 26.

Though a driving gear is provided on the lower half body 3 and a driven gear engaging with the driving gear is provided on the upper half body 5 in the examples mentioned above, the invention is not naturally limited thereto and can take the constitution reverse to the above.

Figure 22:
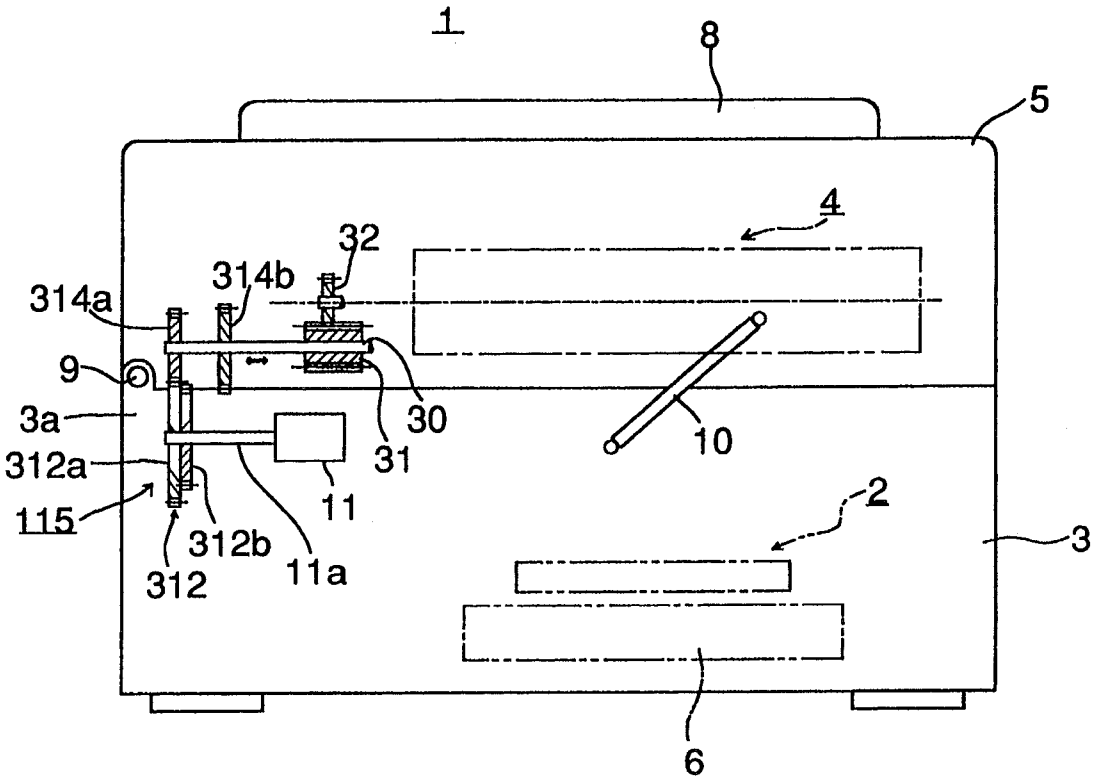
FIG. 22 is a right-hand side view of an image forming apparatus of the fourth example achieving the second object of the invention.
Figure 23:
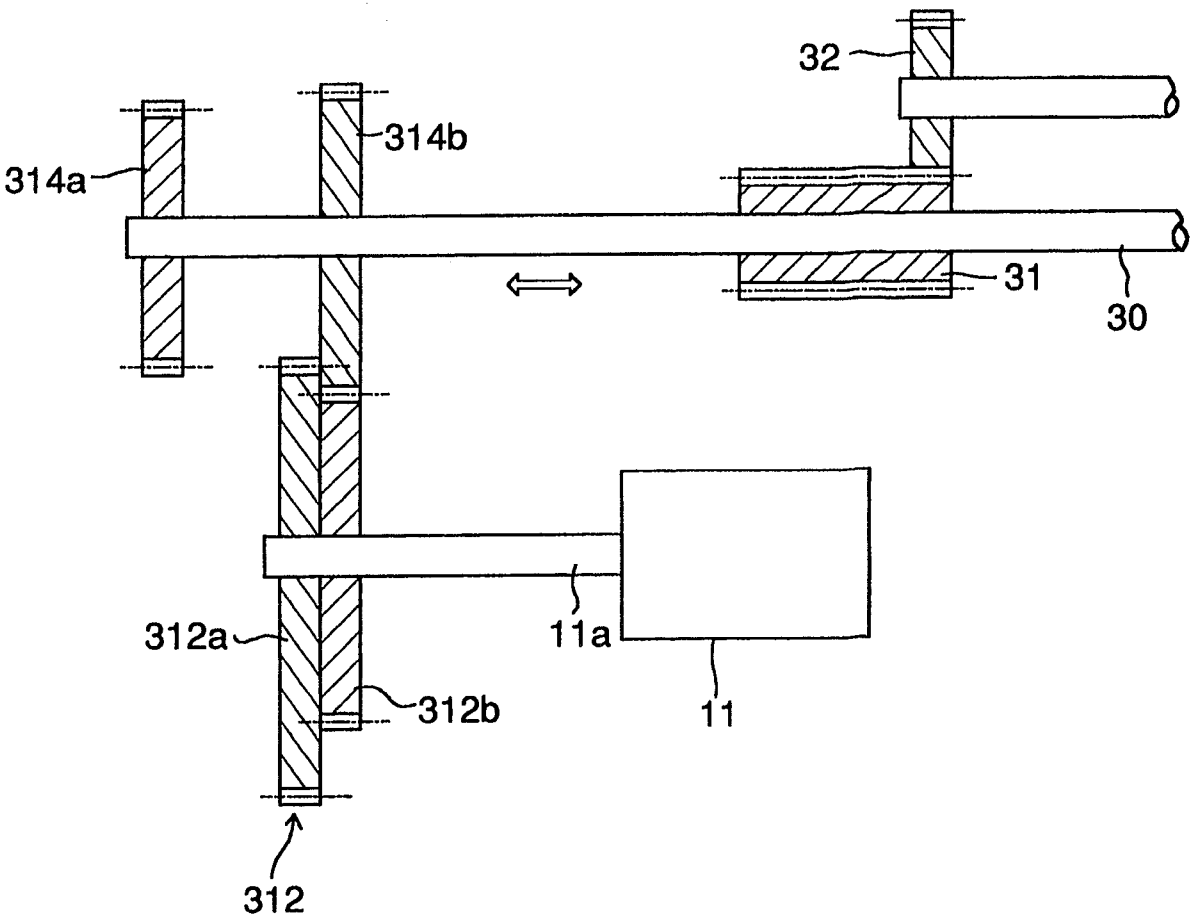
FIG. 23 is an illustration showing the structure and actions of the torque transmission device.
Figure 24:
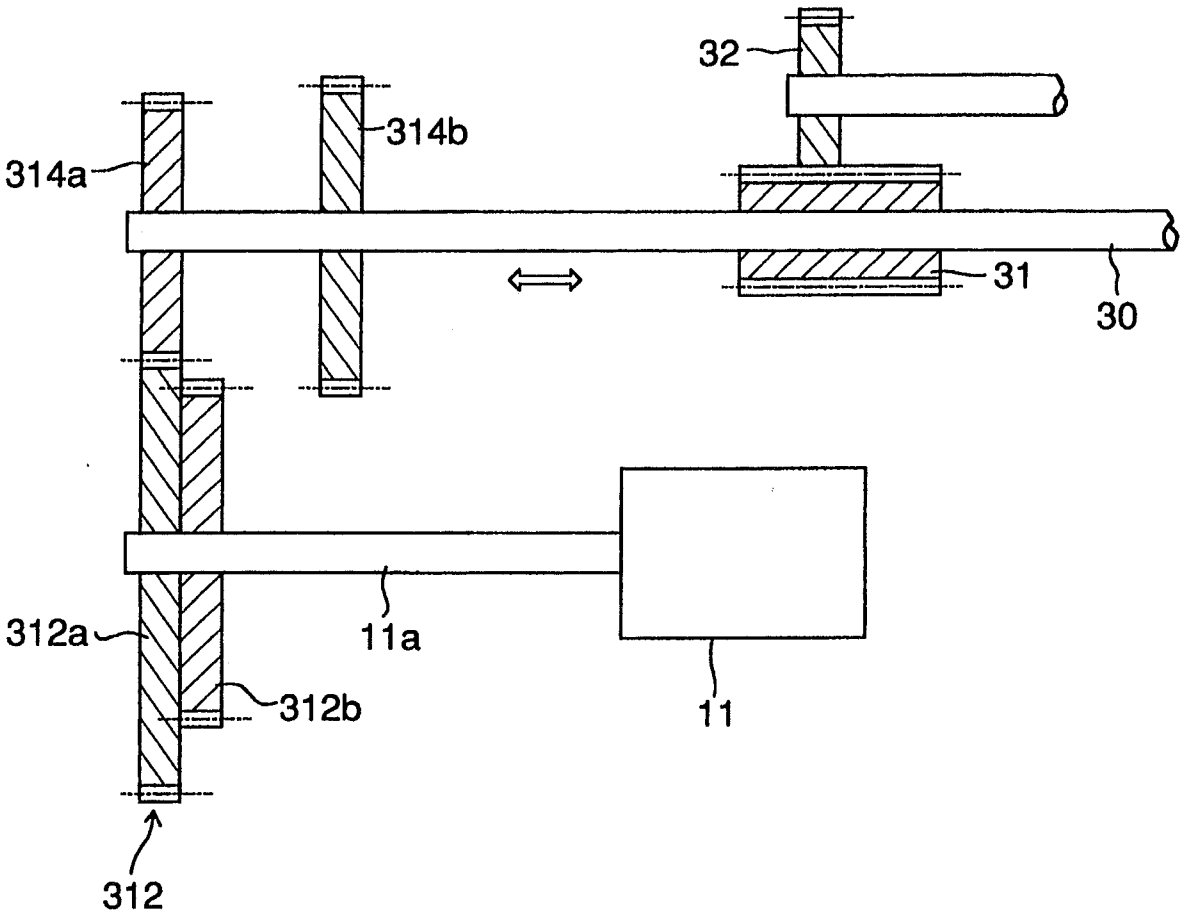
FIG. 24 is another illustration showing the structure and actions of the torque transmission device.
Figure 25:
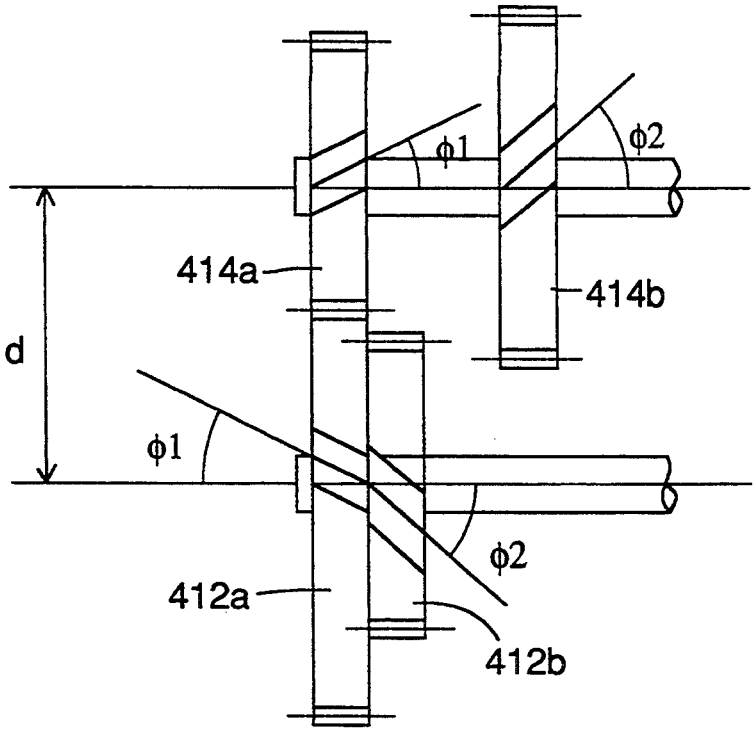
FIG. 25 is an illustration of the torque transmission device employing helical gears.

The fourth example will be explained next, referring to FIGS. 22–25. In this case, FIG. 22 is a left-hand side view of an image forming apparatus, FIG. 23 and FIG. 24 represent illustrations showing how a torque-transmission device is constituted and how it works. FIG. 25 is an illustration of a torque-transmission device in which bevel gears are used. Detailed explanation for symbols in each figure which are identical to those in FIGS. 9–11 will be omitted, because they are the same in structure and action as those in FIGS. 9–11.

On driving shaft 11a of AC motor 11 in lower half body 3 of the image forming apparatus 1, there is affixed two-step driving gear 312 which is composed of two gears differing in diameter and constitutes a driving side of torque-transmission device 15. On driven shaft 30 supported on upper half body 5 in a slidable manner, on the other hand, there are affixed two gears different in diameter, one is small driven gear 314*a* and the other is large driven gear 314*b* both being apart from each other. On the driven shaft 30, there is affixed output-transmitting gear 31 having a large gear width which transmits predetermined torque to output gear 32 which engages with the gear 31.

In the two-step gear 312, large driving gear 312*a* to be used in 50 Hz and small driving gear 312*b* to be used in 60 Hz are arranged to be adjacent each other, and the large driving gear 312*a* engages with the small driven gear 314*a* and the small driving gear 312*b* engages with the large driven gear 14b respectively. These gear combinations can cope with two areas one of which has power supply frequency of 50 Hz and the other has that of 60 Hz, giving the same revolution speed to the output gear 32 in both areas. Namely, the driven shaft 30 is to be slid for selection of either one gear combination depending on power supply frequency in the area where the image forming apparatus is used. FIG. 24 shows an occasion of 50 Hz area, while, FIG. 25 shows that of 60 Hz.

Next, an example wherein a torque-transmission device employing helical gears which can prevent shaky gear engagement and can stand high speed rotation will be explained, referring to FIG. 25. In the case of a helical gear, a helical angle is corrected for adjustment so that two kinds of gear combinations laid across the same shaft-to-shaft distance may have the same circular pitch.

In an example of the correction of helical angles, when the number of teeth of large driving gear 412*a* for 50 Hz is 30 and that of small driven gear 414*a* engaging with the large driving gear 412*a* is 69, mutual helical angle $\theta$ 1 is 24.2°, while, when the number of teeth of small driving gear for 60 Hz is 25 and that of large driven gear 414*b* engaging with the small driving gear 412*b* is 69, mutual helical angle $\theta 2$ is 30.0°. Incidentally, shaft-to-shaft distance d in this case is 43.5 mm.

In the invention described in claim 1, as stated above, the height of engagement between gears provided on the upper half body and those provided on the lower half body is set to be equal to the height of the supporting axis that is a center for pivoting of the upper half body. Therefore, gears on the upper half body engage with those on the lower half body approaching vertically when the upper half body is closed. Accordingly, gears do not approach sideways for engagement thereof, resulting in elimination of improper engagement and gear damage caused by interference thereof.

Further, bevel gears are used for driving gears and driven gears, and their engagement plane is caused to agree with the direction of a radius of a pivoting circle having its center at the supporting axis for the upper half body. Therefore, gears do not approach sideways for engagement thereof, resulting in elimination of improper engagement and gear damage caused by interference thereof, similarly to the above.

On the side plates supporting respectively driving gears and driven gears, there are formed respectively a cam and a cam follower which separate tips of gears vertically. Therefore, gears approach vertically for engagement thereof when the upper half body is closed, resulting in elimination of improper engagement of gears.

Due to the constitution wherein a shaft sliding mechanism is provided, a large driving gear is caused to engage with a small driven gear to cope with one power supply frequency and a small driving gear is caused to engage with a large driven gear to cope with the other power supply frequency, it is easy to select the combination of gears depending on the power supply frequency in the area where the apparatus is used. Due to the constitution capable of being used in common in two areas different in power supply frequency as described above, it is possible to simplify manufacturing steps and reduce production cost, and it is also possible to select the gear combination easily.

Helical gears used in a torque-transmission device inhibit shaky gear engagement and stand high speed rotation of gears, and at the same time, a helical angle is corrected for adjustment so that two kinds of gear combinations laid across the same shaft-to-shaft distance may have the same circular pitch, thereby a precise torque-transmission device can be realized.

Figure 26:
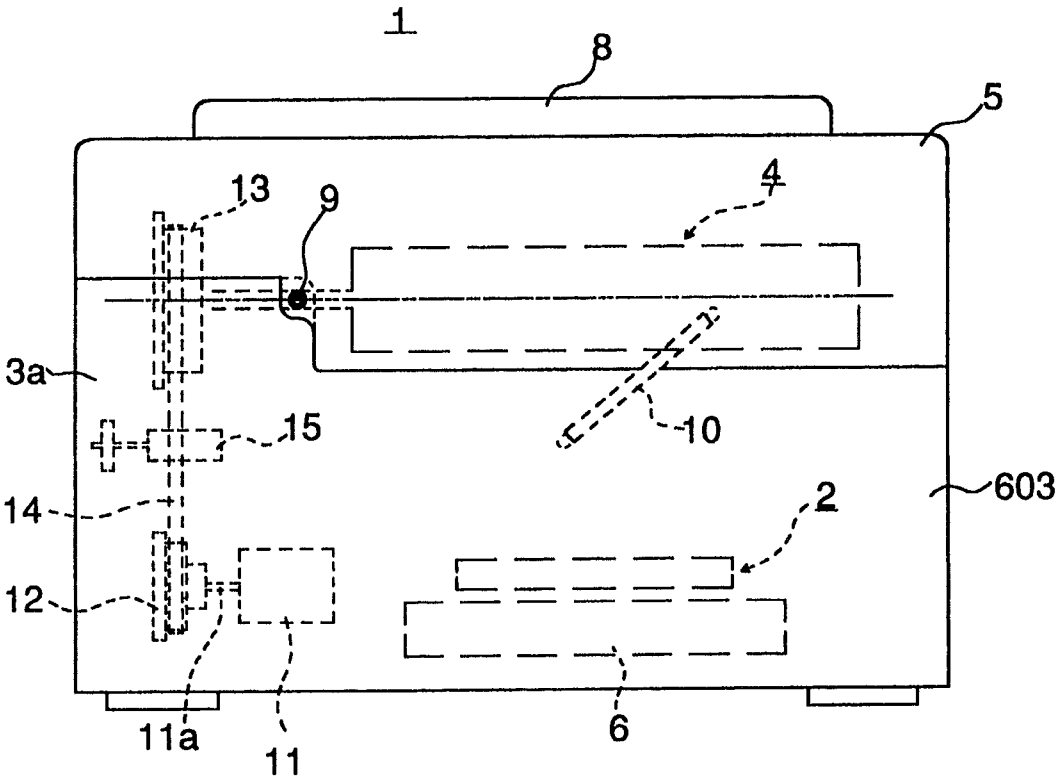
FIG. 26 is a left-hand side view of an image forming apparatus achieving the fourth object of the invention.
Figure 27:
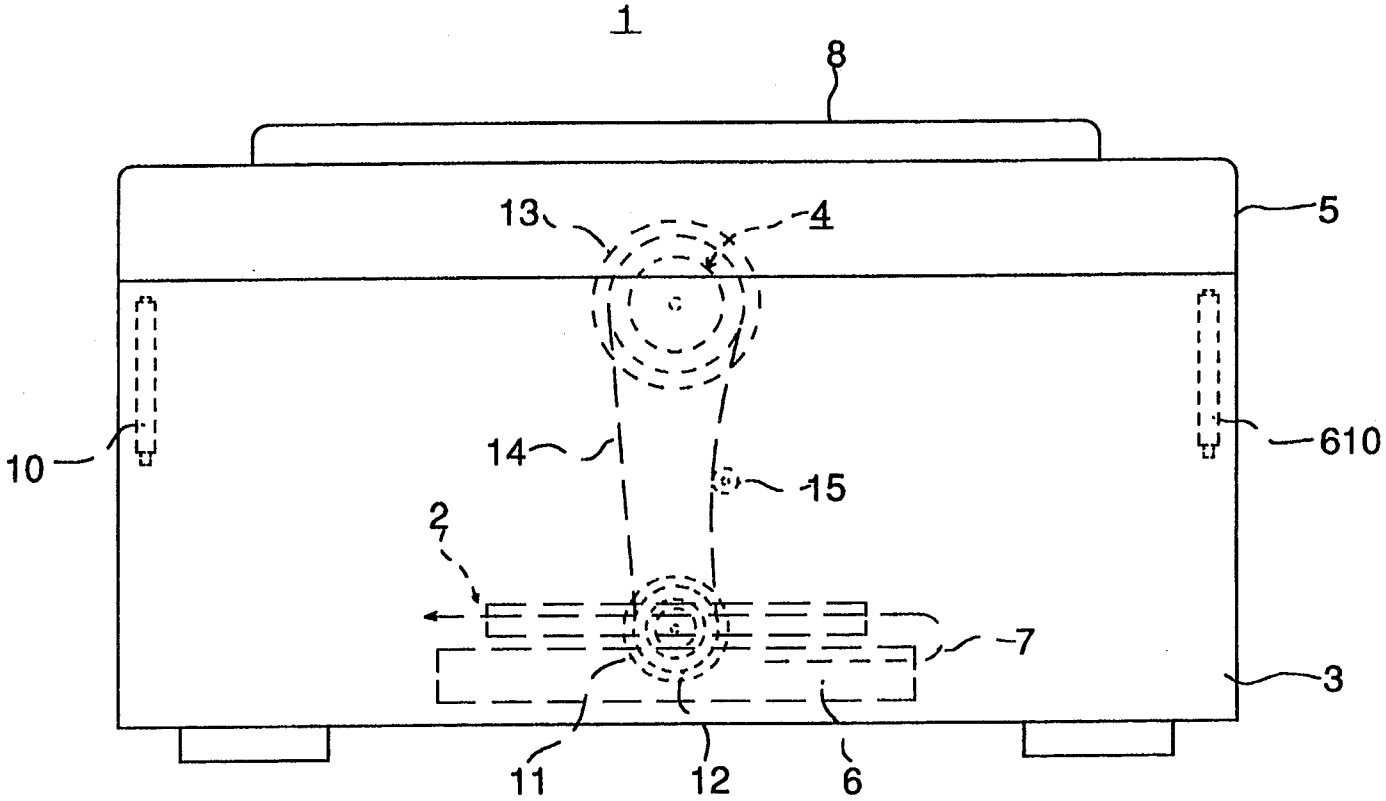
FIG. 27 is a front view of the image forming apparatus in FIG. 26
Figure 28:
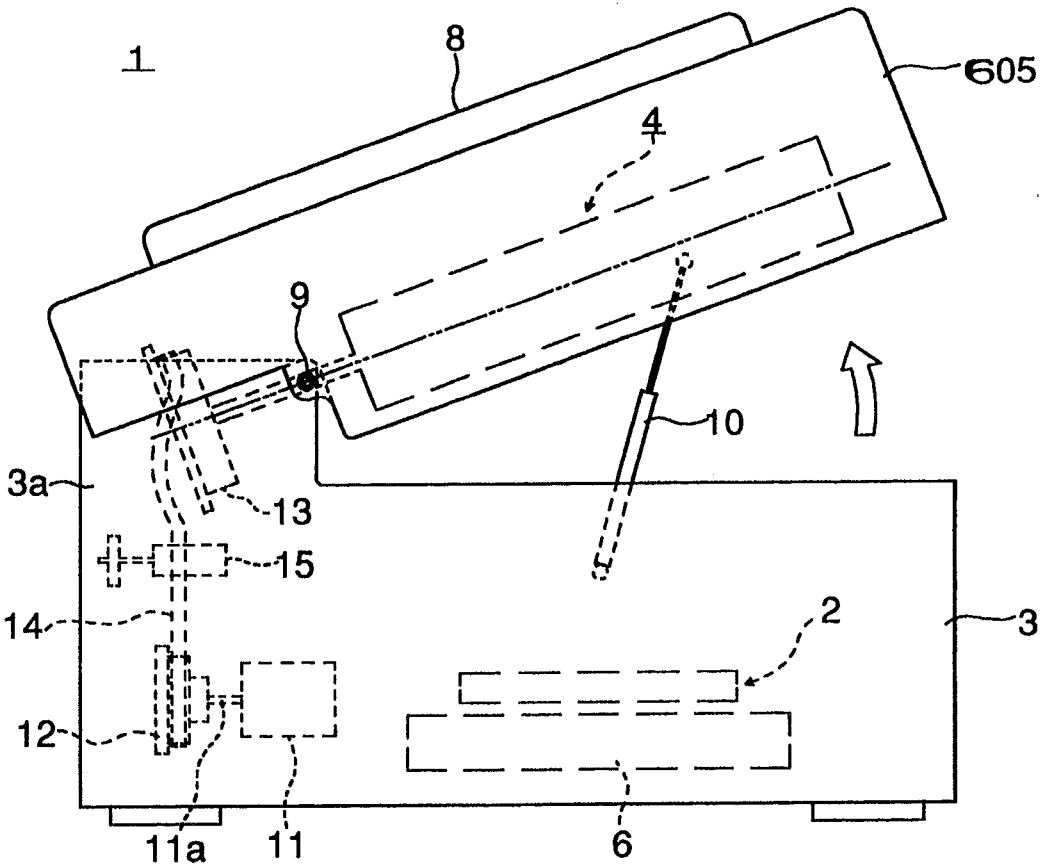
FIG. 28 is a left-hand side view showing the opened state of the image forming apparatus in FIG. 26.
Figure 29:
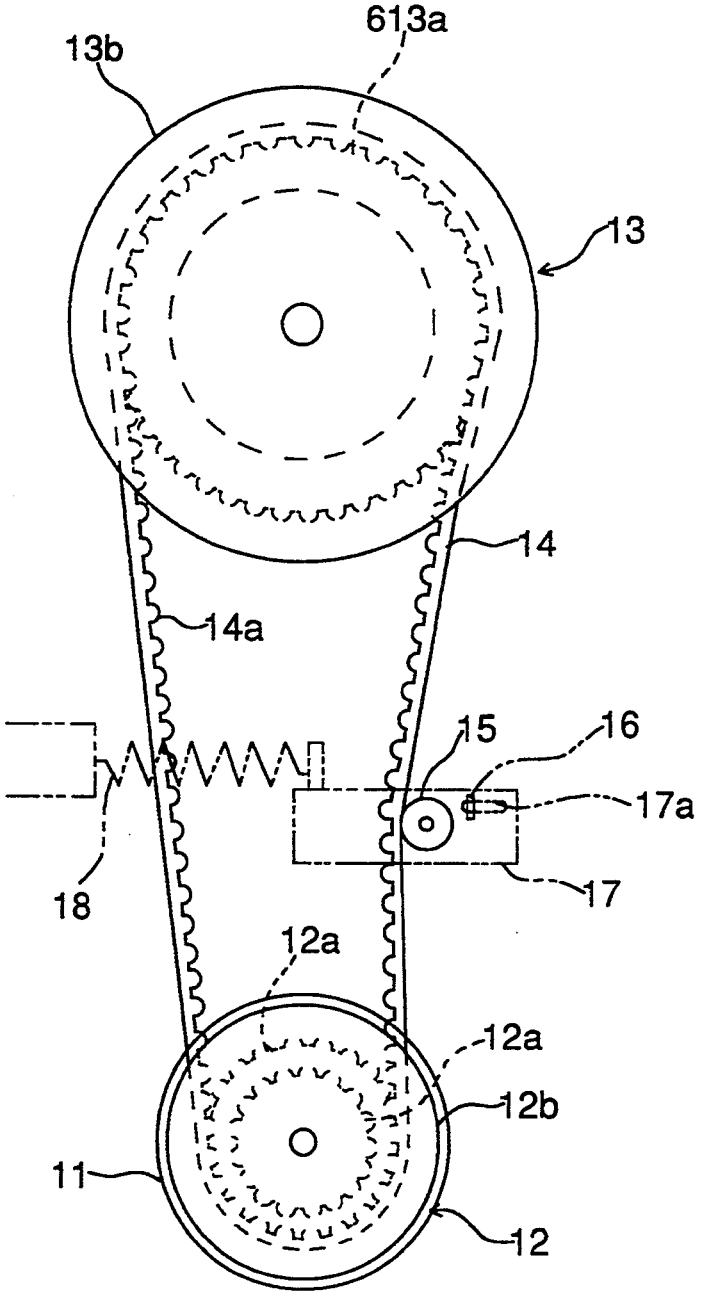
FIG. 29 is a front view of upper and lower rotating objects and spread power-transmitting means.
Figure 30:
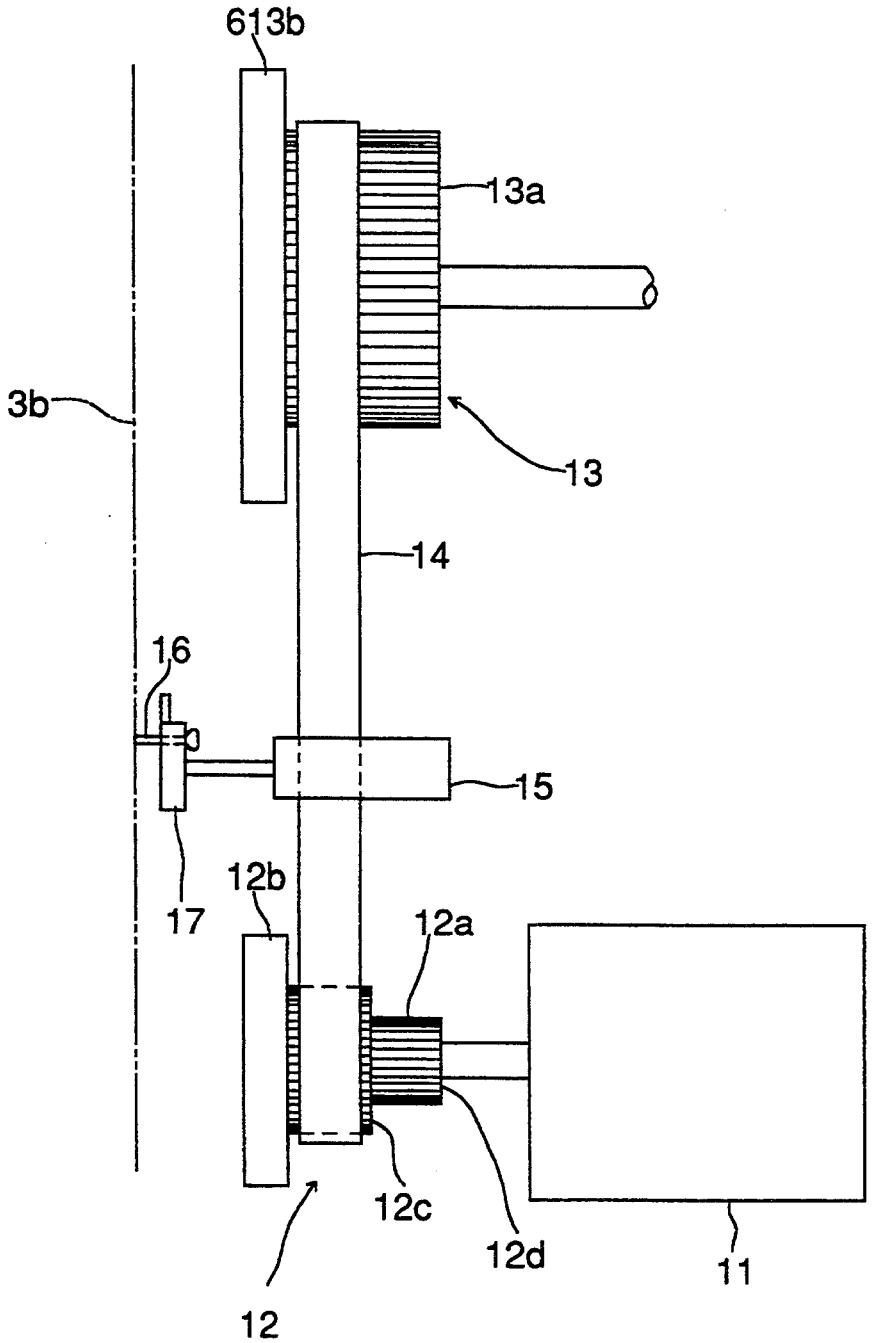
FIG. 30 is a side view of the upper and lower rotating objects and the spread power-transmitting means.

An example of an image forming apparatus achieving the fourth object of the invention will be explained next, referring to drawings attached. In this case, FIG. 26 is a left-hand side view of an image forming apparatus, FIG. 27 is a front view thereof and FIG. 28 is a left-hand side view showing the opened state of the image forming apparatus. FIG. 29 is a front view showing upper and lower rotating members and the constitution of a belt type torque-transmission device, and FIG. 30 is a side view thereof.

Image forming apparatus 601 is composed of lower half body 603 having mechanical device 602 built therein and upper half body 605 having mechanical device 604 built therein as shown in FIGS. 26 and 27. The mechanical device 602 in the lower half body 603 is composed mainly of a sheet conveyance unit for a sheet fed out of sheet feeding cassette 606, and a sheet fed out of the sheet feeding cassette 606 is conveyed from the right side of the lower half body 603 to the left side thereof by the conveyance unit, and sheet conveyance path 607 is formed laterally. The mechanical device 604 in the upper half body 605 is composed mainly of an image forming process unit including a photoreceptor drum, and platen cover 608 is provided on top of the upper half body 605.

In the rear of the lower half body 603, there is formed supporting unit 603*a* on which the upper half body 605 is provided to be capable of opening and closing with supporting axis 609 running parallel with sheet material conveyance path 607 as a fulcrum, and an urging member such as gas spring 610 or the like is provided between the lower half body 603 and the upper half body 605. Therefore, when sheet jamming or the like takes place, a front portion of the upper half body 605 is lifted to a predetermined position as shown in FIG. 28 so that the upper half body 605 may swing. The swung position of the upper half body 605 is held by elasticity of the gas spring 610.

AC motor 611 is provided on the lower half body 603 as a driving source, and two-step pulley 612 constituting driving pulleys having different diameters as a lower rotating member is affixed on driving shaft 611*a* of the AC motor 611. On the upper half body 605, on the other hand, there is provided driven-side pulley 613 that is an upper rotating member for rotating the photoreceptor drum or the like in the mechanical device 604. This driven-side pulley 613 constitutes a driven pulley which is located behind supporting axis 609 against the opening side of the upper half body 605. Between the two-step pulley 612 and the driven-side pulley 613, there is spread timing belt 614 which is a belt type torque-transmission device. Further, between both rotating members, there is provided tension roller 615 that gives tension properly to the timing belt 614.

The rotating member and the belt type torque-transmission device mentioned above will be explained in detail, referring to FIGS. 29 and 30. On the internal surface of the timing belt 614, there are formed rounded teeth 614*a* at equal spaces of pitches which engage with teeth 613*a* and 612*a* formed respectively on the external surface of the driven-side pulley 613 and on the external surface of the two-step pulley 612. Further, on the driven-side pulley 613 and the two-step pulley 612, there are formed respectively flanges 613*b* and 612*b* on the opposite side to the supporting axis 609 so that the flanges may prevent loosened timing belt 614 from coming off when the upper half body is opened.

The two-step pulley 612 is of a constitution wherein two pulleys of large pulley 612*c* for 50 Hz and small pulley 612*d* for 60 Hz are adjacent to each other, and each of them is adjusted so that the speed of revolution of the driven-side pulley 613 may be the same for two areas having respectively different power supply frequencies of 50 Hz and 60 Hz. Therefore, the timing belt 614 is spread over either one pulley depending on power supply frequency in the area where the apparatus is used. FIGS. 29 and 30 show the occasion wherein the apparatus is used in the area where the power supply frequency is 50 Hz.

The tension roller 615 is supported on supporting plate 617 that is fixed by bolt an nut 616 in a slidable manner on rear panel 603*b* of the lower half body 603, and it presses the spread timing belt 614 from the outside so that the timing belt may have optimum tension. Incidentally, the supporting plate 617 is provided with elongated hole 617*a* through which the bolt and nut 616 passes so that the supporting plate can slide following the loosening of the timing belt 614. Since the supporting plate 617 is urged with the constant force of elastic member 618, even when the timing belt 614 is replaced, the supporting plate slides automatically if the bolt and nut 616 is loosened, and the tension roller 615 presses the timing belt 614 with constant force, thus, the position that gives proper tension to the belt can easily be determined.

Figure 31:
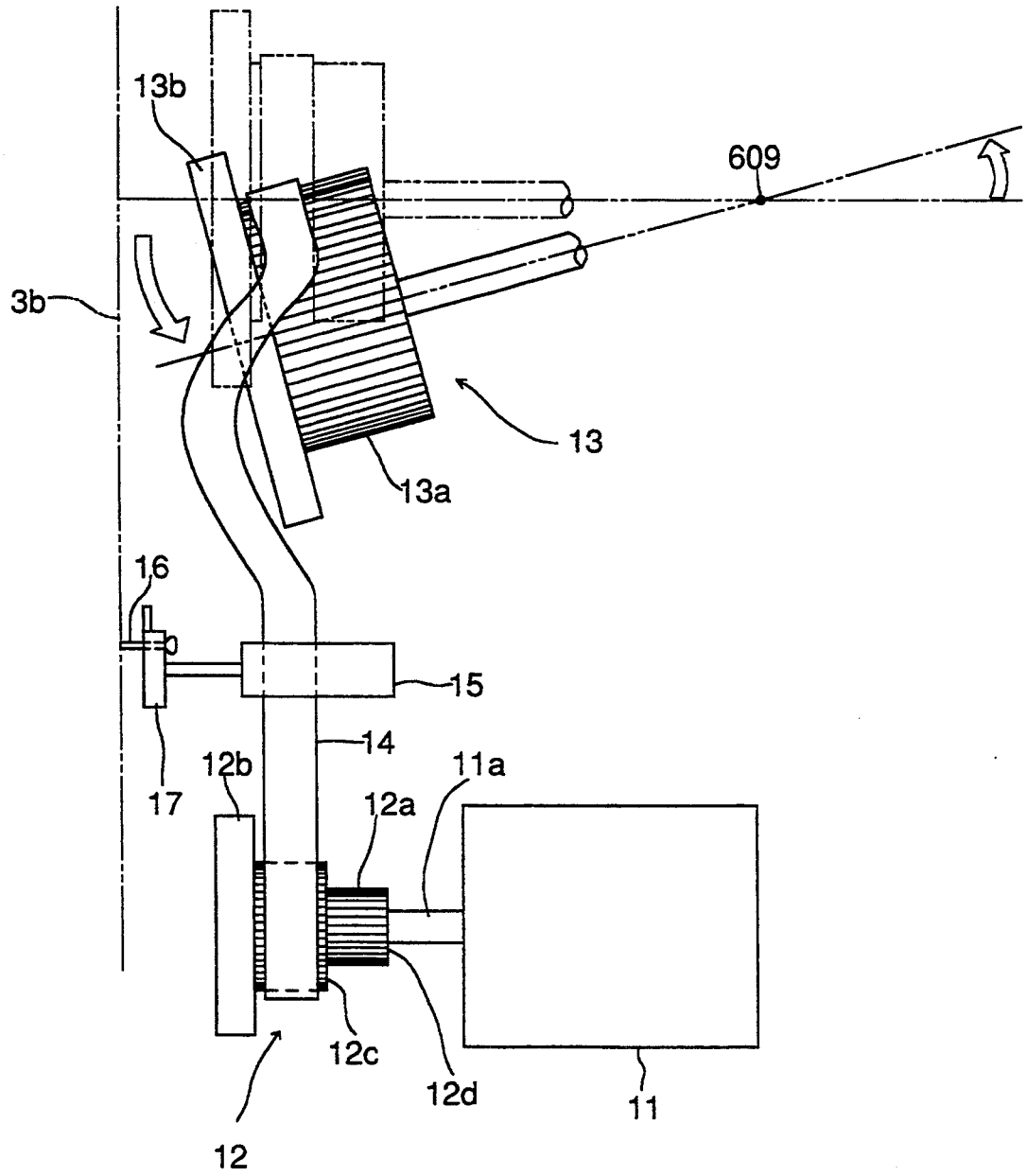
FIG. 31 is a side view illustrating how the rotating objects and the spread power-transmitting means move when opening.

Actions of the driven-side pulley 613 and the timing belt 614 made when the upper half body 605 is opened will be explained next, referring to FIGS. 28 and 31. FIG. 31 represents a side view illustrating the movements of a rotating member and a belt type torque-transmission device made when the upper half body 605 is opened. When the upper half body 605 is opened, the driven-side pulley 613 pivots with supporting axis 609 as a center. In this case, the driven-side pulley 613 pivots downwards because it is located behind the supporting axis 609, and thereby the distance between the driven-side pulley 613 and the two-step pulley 612 is shortened. Therefore, tension of the timing belt 614 is reduced. The loosened timing belt 614 is held by flanges 613*b* and 612*b* which are for preventing the belt from coming off.

Incidentally, the upper and lower rotating members and the belt type torque-transmission device explained above are not limited to the above constitution, and sprockets, chains or wires may also be used instead, or the driving source may also be provided on the upper half.

The shaft of the driven-side pulley 613 has a width equal to or greater than the width equivalent to two steps of the two-step pulley 612, making the belt to be spread smoothly over the proper diameter portion of a belt type torque-transmission device.

The width of the tension roller 615 is equal to or greater than the width equivalent to two steps of the two-step pulley 612 in the same manner as in the above, making the belt to be spread smoothly over the proper diameter portion of a belt type torque-transmission device.

Figure 32:
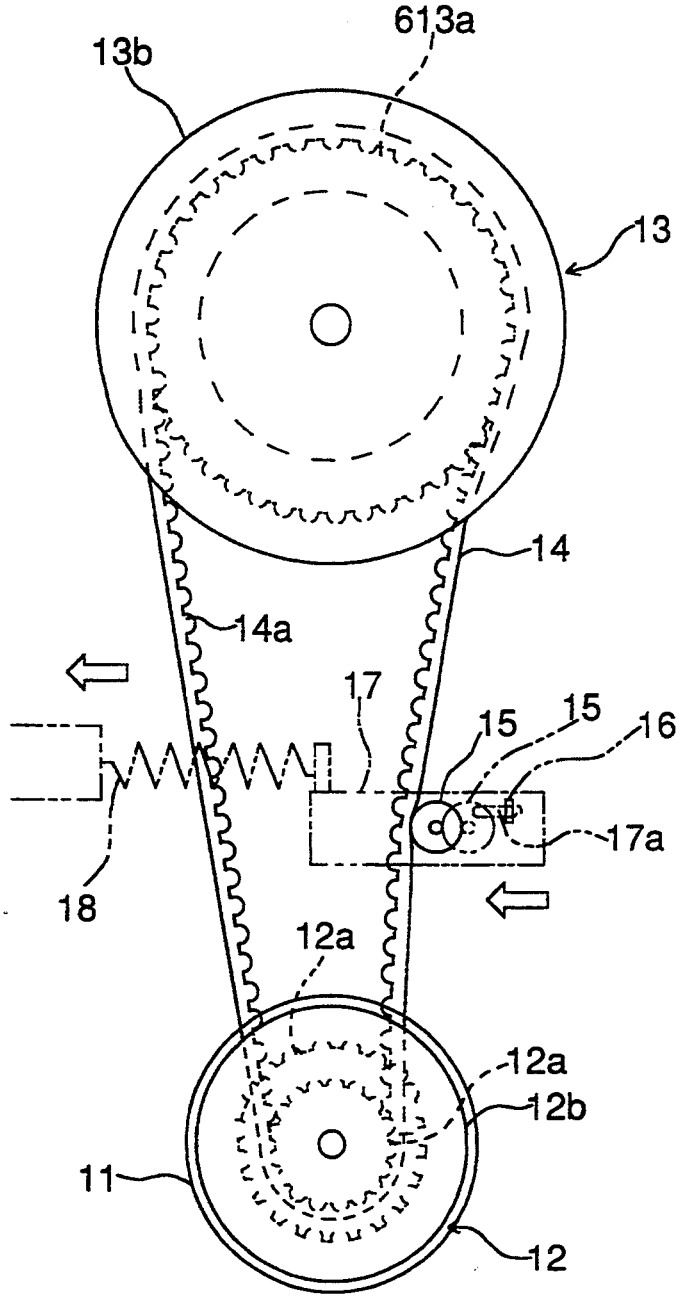
FIG. 32 is a front view of the rotating objects and the spread power-transmitting means under the condition of 60 Hz.
Figure 33:
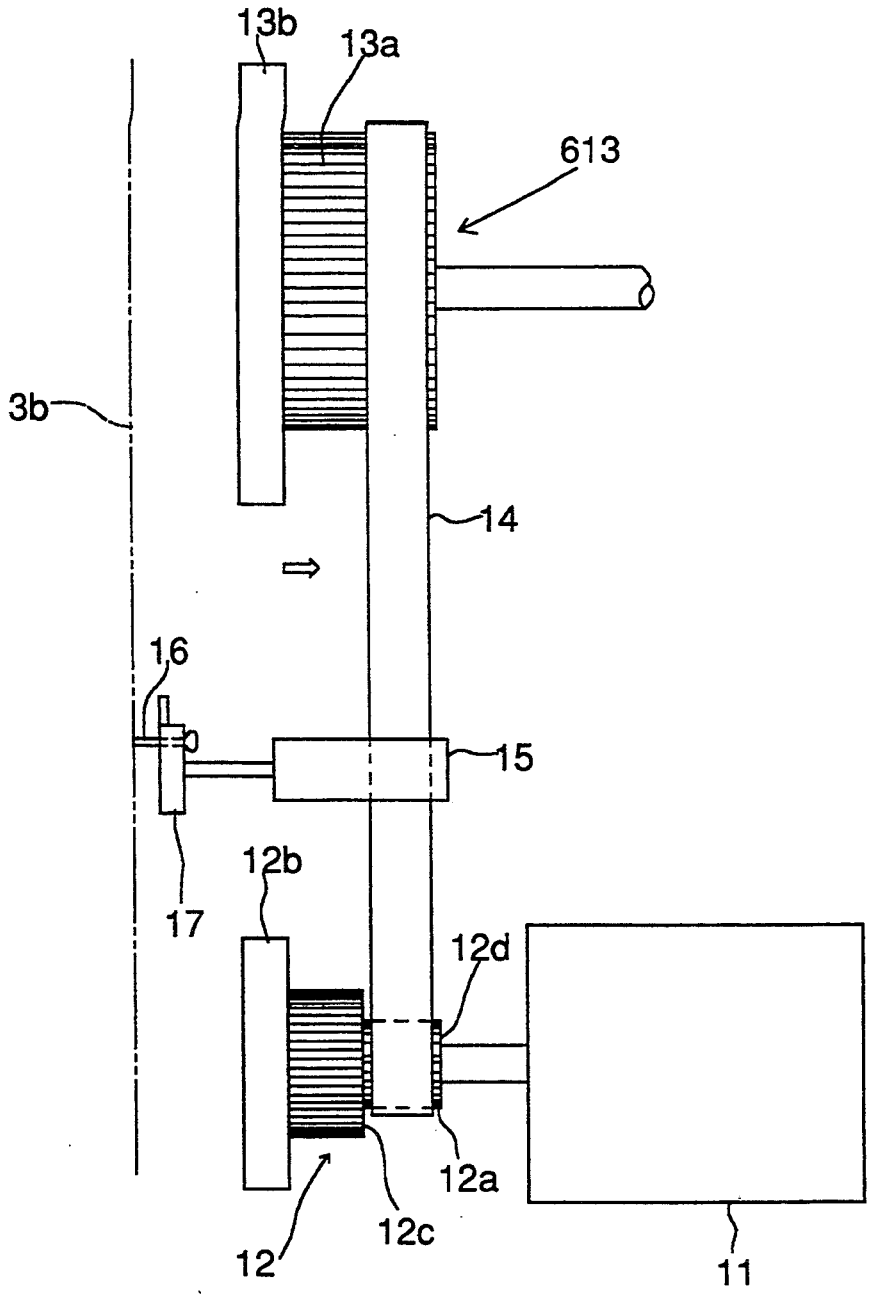
FIG. 33 is a side view of the rotating objects and the spread power-transmitting means under the condition of 60 Hz.

Next, actions to be taken when the image forming apparatus 601 is moved from the area of 50 Hz to the area of 60 Hz for the use thereof will be explained, referring to FIGS. 32 and 33. FIG. 32 is a front view showing the constitution of the upper and lower rotating members and the belt type torque-transmission device, and FIG. 33 is a side view thereof. First, the bolt and not 616 affixing the supporting plate 617 is loosened and the timing belt 614 is moved to be spread over the small pulley 612*d* for 60 Hz. In this case, the supporting plate 617 slides along the elongated hole 617*a* due to the elastic force of the elastic member 618, and the tension roller 615 presses the timing belt 614 and the position that gives the proper tension to the belt is determined. After that, the bolt and nut 616 is tightened again.

Figure 34:
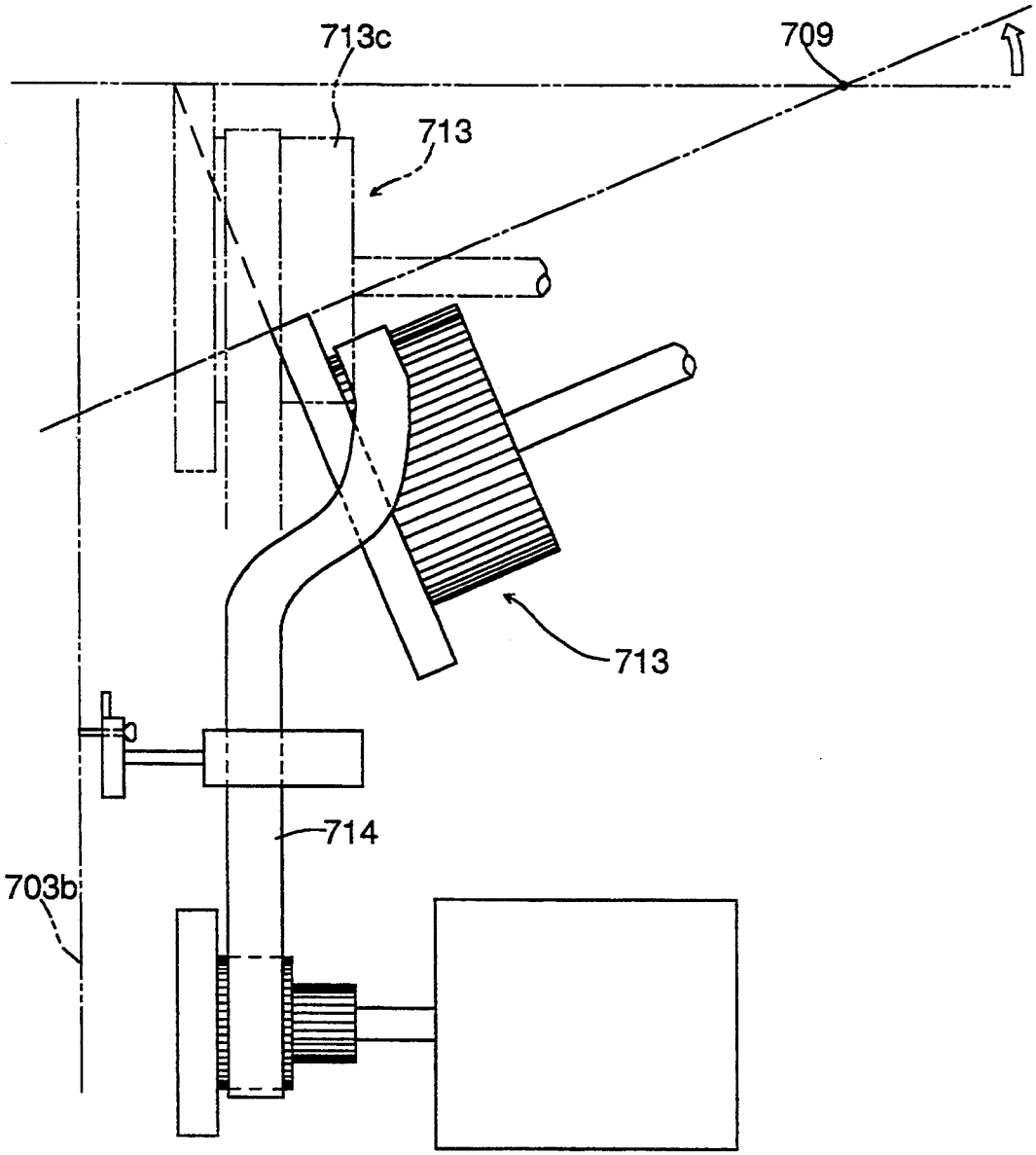
FIG. 34 is a side view illustrating how the rotating objects and the spread power-transmitting means move in the course of opening.

Next, another example wherein the upper position of contact between an upper rotating member and a belt type torque-transmission device is lower than the height of a supporting axis will be explained referring to FIG. 34. FIG. 34 represents a side view illustrating how the rotating member and the belt type torque-transmission device move when an upper half body is opened. In FIG. 34, upper position of engagement 713*c* between timing belt 714 and driven-side pulley 713 is equal to or lower than the height of supporting axis 109. Accordingly, a locus of the pivoting movement of the driven-side pulley 713 made when the upper half body is opened passes the internal side of the position corresponding to the closed upper half body, eliminating the fear that the driven-side pulley 713 hits, when it pivots, some member located behind thereof. Therefore, it is possible to locate the driven-side pulley 713 so that it may be adjacent to rear plate 703*b* on a lower half body.

As stated above, in the invention according to claim 1 wherein an upper rotating member is positioned behind a supporting axis, the upper rotating member pivots downwards when an upper half body is opened, causing the tension of a belt type torque-transmission means spread over the upper rotating member to be reduced. Owing to this, it is possible to prevent that excessive tension is applied on the belt type torque-transmission means when the upper half body is opened, and it is further possible to reduce load caused by opening the upper half body.

Further, in the invention according to claim 2 wherein the upper plane of contact between an upper rotating member and a belt type torque-transmission means is positioned below a supporting axis, a locus of the movement of the upper rotating member made when an upper half body is opened can pass inside the position corresponding to the closed upper half body. Owing to this, the free space behind the upper rotating member is expanded and the upper rotating member can be positioned to be adjacent to the wall of a lower half body.

In the invention according to claim 3 wherein a driving pulley is a two-step pulley having different diameters, it is possible to move a belt type torque-transmission means to be spread depending on power supply frequency in the area where an apparatus is used. In this case, the slack caused by the difference of pulley diameters can be eliminated because a tension roller gives tension to the belt type torque-transmission means. Due to the constitution capable of being used in common in two areas different in power supply frequency as described above, it is possible to simplify manufacturing steps and reduce production cost, and it is also possible to select the gear combination easily.

In the invention according to claim 4, the width of a driven pulley is equal to or greater than the width equivalent to two steps of a driving pulley, and it is possible to spread a belt type torque-transmission means over the proper diameter portion smoothly.

In the invention according to claim 5, the width of a tension roller is equal to or greater than that of a driving pulley, and it is possible to spread a belt type torque-transmission means over the proper diameter portion smoothly.

What is claimed is:

1. An image forming apparatus, comprising:

a body including a lower half body and an upper half body;

a sheet conveyance means provided in said lower half body and having a sheet passage having a width to convey a recording sheet, said sheet passage being arranged between a first side of said body and a second side of said body opposite to said first side so that said recording sheet is conveyed from said first side to said second side or from said second side to said first side;

an image forming means provided in said upper half body;

said upper half body being mounted on said lower half body and having an axis arranged on a third side of said body in parallel to said sheet passage so that said upper half body is pivotable relative to said lower half body around said axis; and a platen cover provided on said upper half body and having an axis arranged on said third side of said body and being in parallel to said axis of said upper half body so as to pivotally open or close in the same direction as that of said upper half body;

wherein a sum of a pivot angle of said upper half body relative to the lower half body plus a pivot angle between said platen cover and said upper half body is smaller than 90 degrees for all positions of said upper half body and for all positions of said platen cover.

2. The apparatus of claim 1, wherein said third side of said body intersects the first and second sides, said third side not being within said width of said sheet passage when said sheet passage is viewed in a top view thereof.

3. The apparatus of claim 2, further comprising:

a front door provided at a fourth side of said body opposite to said third side of said body so that said passage is provided between said axis of said upper half body and said front door; and coupling means for transmitting power from a power source from said lower half body to said upper half body; and wherein said axis of said upper half body is arranged in said apparatus to be at a position above said sheet passage.

4. The apparatus of claim 3, wherein said width of said sheet passage is at least equal to a width of a largest recording sheet conveyed in said sheet passage.

5. The apparatus of claim 1, wherein said position of said axis of said upper half body is arranged in said image forming apparatus at a position that is above said sheet passage.

6. The apparatus of claim 1, wherein:

said platen cover comprises a document feeder provided on said upper half body, said document feeder being pivotally openable and closeable in the same direction as that of said upper half body; and the sum of a pivot angle of said upper half body and of said document feeder is smaller than 90 degrees.

7. The apparatus of claim 1, wherein said axis of said upper half body is arranged in said apparatus to be at a position above said sheet passage.

8. An image forming apparatus, comprising:

a body including a lower half body and-an upper half body;

a sheet conveyance means provided in said lower half body and having a sheet passage having a width to convey a recording sheet, said sheet passage being arranged between a first side of said body and a second side of said body opposite to said first side;

an image forming means provided in said upper half body;

said upper half body being mounted on said lower half body, said upper half body having an axis arranged in parallel to said sheet passage so that said upper half body is pivotable relative to said lower half body around said axis, said upper half body being pivotable relative to said lower half body in opening and closing directions of said upper half body; and a platen cover provided on said upper half body so as to pivotally open and close in directions that respectively corresponds to said opening and closing directions of said upper half body relative to said lower half body;

wherein a sum of a pivot angle of said upper half body relative to said lower half body plus a pivot angle between said platen cover and said upper half body is smaller than 90 degrees;

wherein said axis is arranged at a position at a third side of said body that is not within said width of said sheet passage when said sheet passage is viewed in a top view thereof;

a front door provided at a fourth side of said body opposite to said third side of said body so that said passage is provided between said axis and said front door; and a coupling means for transmitting power from a power source from said lower half body to said upper half body; and wherein said axis is arranged in said image forming apparatus at a position that is above said sheet passage.

9. The apparatus of claim 8, wherein:

said upper half body comprises a handle with which said upper half body is opened or closed;

said front door comprises a front cover portion to cover a front side of said body and an upper cover portion to cover said handle of said upper half body; and an operation panel is provided on said upper cover portion.

10. The apparatus of claim 8, wherein an operation panel is provided at a front side of said upper half body which comprises a pivotable upper cover to cover said operation panel, and wherein said upper cover and said front door each has an engaging portion to come in engagement with each other so that when said front door closes the front side of said body, said upper cover is pivoted by the close movement of said front door and takes a position not to cover said operation panel, and when said front door opens the front side of said body, said upper cover takes a position to cover said operation panel.

11. The apparatus of claim 8, further comprising transmitting means for transmitting power from a power source between said upper half body and said lower half body, wherein said transmitting means includes an upper pulley, a lower pulley and a belt looped around said upper and lower pulleys and said upper pulley is arranged so that said axis of said upper half body is positioned between said sheet passage and said upper pulley.

12. The apparatus of claim 11, wherein said upper pulley is positioned not higher in said body than the position of said axis of said upper half body.

13. The apparatus of claim 11, wherein:

one of said upper and lower pulley is a driving pulley mounted on a drive shaft of a motor and the other of said upper and lower pulley is a driven pulley; and said driving pulley comprises two different size pulleys which are selectively used in accordance with a frequency of the power source.

14. The apparatus of claim 13 further comprising a tension roller to adjust the tension on said belt.

15. The apparatus of claim 14, wherein said tension roller has a width not smaller than a total width of said two different size pulleys.

16. The apparatus of claim 13, wherein said driven pulley has a width not smaller than a total width of said two different pulleys.

* * * * *